US006960972B2

(12) United States Patent
Nakamura et al.

(10) Patent No.: US 6,960,972 B2
(45) Date of Patent: Nov. 1, 2005

(54) HIGH-FREQUENCY RELAY HAVING A CONDUCTIVE AND GROUNDING BASE COVERING AT LEAST A BOTTOM SURFACE OF A BODY

(75) Inventors: Akio Nakamura, Shinagawa (JP); Yoshinori Kurata, Shinagawa (JP); Hirofumi Saso, Shinagawa (JP)

(73) Assignee: Fujitsu Component Limited, Tokyo (JP)

( * ) Notice: Subject to any disclaimer, the term of this patent is extended or adjusted under 35 U.S.C. 154(b) by 0 days.

(21) Appl. No.: 10/151,969

(22) Filed: May 22, 2002

(65) Prior Publication Data

US 2003/0080840 A1 May 1, 2003

(30) Foreign Application Priority Data

Oct. 25, 2001 (JP) ..... 2001-328209

(51) Int. Cl.[7] ..... H01H 51/22
(52) U.S. Cl. ..... 335/128; 335/202
(58) Field of Search ..... 335/78–86, 124–131, 335/202; 174/35 R

(56) References Cited

U.S. PATENT DOCUMENTS 3,377,449 A * 4/1968 Marquis ..... 200/504
4,626,812 A * 12/1986 Nakanishi et al. ..... 335/132
5,008,487 A * 4/1991 Shimmyo ..... 174/35 R
5,815,057 A * 9/1998 Hoffman et al. ..... 335/4
5,994,988 A * 11/1999 Ferree et al. ..... 335/78
6,340,923 B1 * 1/2002 Yamanaka et al. ..... 335/4
6,424,242 B1 * 7/2002 Shinoura et al. ..... 335/78

FOREIGN PATENT DOCUMENTS

JP 2000-340084 12/2000

* cited by examiner

*Primary Examiner*—Lincoln Donovan
(74) *Attorney, Agent, or Firm*—Staas & Halsey LLP

(57) ABSTRACT

A high-frequency relay comprises a body containing a contact unit having at least one contact terminal protruding from a bottom surface of the body, contact states switched according to energization of a coil and a base covering at least a bottom surface of the body. The contact unit is connected with at least one contact terminal. The base has a grounding function and includes a conductive layer.

33 Claims, 44 Drawing Sheets

10p

HIGH-FREQUENCY RELAY HAVING A CONDUCTIVE AND GROUNDING BASE COVERING AT LEAST A BOTTOM SURFACE OF A BODY

BACKGROUND OF THE INVENTION

1. Field of the Invention

The present invention generally relates to a high-frequency relay, and more particularly, to a high-frequency relay switching a high-frequency signal.

2. Description of the Related Art

FIG. 1A and FIG. 1B illustrate an example of a high-frequency relay.

A high-frequency relay 1*a* comprises an electromagnet unit 2 and a contact unit 3.

The electromagnet unit 2 comprises an iron core 2*a,* a coil 2*b* wound around the iron core 2*a,* and a coil terminal 2*c* connected to the coil 2*b.* The coil terminal 2*c* hangs down so as to be connected to a substrate not shown in the figure.

The contact unit 3 comprises a moving contact unit 4, a fixed make contact unit 5 and a fixed break contact unit 6. The fixed make contact unit 5 and the fixed break contact unit 6 are provided at positions opposite both ends of the moving contact unit 4.

The moving contact unit 4 includes an armature 4*b* provided opposite the electromagnet unit 2. A permanent magnet 4*a* is mounted to the armature 4*b*. A moving spring 4*c* is arranged unitarily with the armature 4*b*. A moving make contact 4*d* and a moving break contact 4*e* are provided at both ends of the moving contact unit 4. The moving contact unit 4 also includes a common terminal 4*f* hanging down so as to be connected to a substrate not shown in the figure.

The fixed make contact unit 5 comprises a fixed make contact 5*a* arranged opposite the moving make contact 4*d,* and a make terminal 5*b* hanging down so as to be connected to a substrate not shown in the figure.

The fixed break contact unit 6 comprises a fixed break contact 6*a* arranged opposite the moving break contact 4*e,* and a break terminal 6*b* hanging down so as to be connected to a substrate not shown in the figure.

Besides, the relay has a structure in which a contact drive card is provided by bridging and holding the armature 4*b* and the moving spring 4*c*.

With the relay 1*a* in use, the moving spring 4*c* moves according to energization of the coil 2*b* so as to switch between a make state in which the moving make contact 4*d* contacts the fixed make contact 5*a* and a break state in which the moving break contact 4*e* contacts the fixed break contact 6*a*. This relay may be referred to as a one-point break one-point make structure type.

With such a high-frequency relay as above, that switches a high-frequency signal, an isolation characteristic is the most important of various characteristics required for the signal switching capability.

The isolation characteristic represents a leakage of a signal between a moving contact and a fixed contact (herein below simply referred to as contacts) in a state where the contacts are broken. As a frequency of the signal becomes higher, the leakage increases. The isolation is defined by the following expression and, as a value obtained by this expression becomes larger, the isolation exhibits a better characteristic:

Isolation=−10 log(Pout/Pin) (unit: dB)

Pout: output power

Pin: input power

In order to increase the isolation characteristic, it is necessary to reduce a capacitance between the broken contacts.

Specific methods for reducing the capacitance between the broken contacts include enlarging a clearance between the contacts, and decreasing opposing areas between the contacts.

However, in the example of the high-frequency relay 1*a* of the one-point break one-point make structure shown in FIG. 1A and FIG. 1B, there is provided a magnetic circuit component which is a floating conductor, such as the iron core 2*a* or the permanent magnet 4*a,* in the vicinity of which the contacts 4*d* and 5*a* are arranged. Therefore, a leakage of a signal is large between the magnetic circuit component and each of the contacts 4*d* and 5*a,* between the magnetic circuit component and each of the terminals 4*f* and 5*b* connected to the contacts 4*d* and 5*a,* respectively, and between the terminals 4*f* and 5*b.* Therefore, the above-mentioned methods, such as enlarging a clearance between the contacts 4*d* and 5*a,* are not necessarily effective. In addition, to extremely enlarge the clearance between the contacts 4*d* and 5*a* makes an obstacle hindering miniaturization needs for the relay.

There is a method for solving the above-described problems of the relay 1*a* shown in FIG. 1A and FIG. 1B. In a relay 1*b* of a two-point break two-point make structure shown in FIG. 2, this method reduces a stray capacitance by grounding a moving make spring 7*c* via ground terminals 7*d* upon breaking the contacts. In FIG. 2, reference mark 7*a* indicates a moving break spring, and reference mark 7*b* indicates common fixed contacts. In addition, there are relays 1*c* and 1*d* shown in FIG. 3 and FIG. 4, respectively, in which grounded shield plates 7*f* are provided at peripheries of the contact unit. In FIG. 3 and FIG. 4, reference mark 7*e* indicates a card, and reference mark 7*g* indicates a resinous base. In these examples, however, the relay 1*c* shown in FIG. 3 has a structure in which the contact unit and the magnetic circuit are separated; this hinders miniaturization of the relay. Also, as in the relay 1*d* shown in FIG. 4, the grounded shield plates 7*f* make a complicated structure; thus, the components cannot be easily manufactured and mounted. It is noted here that, in FIG. 2 to FIG. 4 and other figures illustrating relays, the same elements are basically referenced by the same reference marks, and will not be described in detail.

In addition, for the purpose of further improving the isolation characteristic, there are a relay 1*e* as shown in FIG. 5A to FIG. 5C and a relay 1*f* as shown in FIG. 6A to FIG. 6C. In the relay 1*e* shown in FIG. 5A to FIG. 5C, a metal plating 7*h* is provided on a terminal-outlet surface 8*a* located at a bottom part of a resinous cover 8 so that the metal plating 7*h* electrically connects to the ground terminals 7*d* projecting from inside, avoiding the contact terminals 4*f,* 5*b* and 6*b.* In the relay if shown in FIG. 6A to FIG. 6C, a large metal plate 7*h* connected with the ground terminals 7*d* is so provided as to avoid the contact terminals 4*f,* 5*b* and 6*b* to an extent that the contact terminals 4*f,* 5*b* and 6*b* do not short.

Further, Japanese Laid-Open Patent Application No. 2000-340084 proposes a relay 1*g,* as shown in FIG. 7A and FIG. 7B, (the body of) which is covered by a metal case (a conductor cover) 9 provided with the ground terminals 7*d*.

However, the heretofore-described conventional relays do not necessarily provide a satisfactory isolation characteristic.

SUMMARY OF THE INVENTION

It is a general object of the present invention to provide an improved and useful high-frequency relay in which the above-mentioned problems are eliminated.

A more specific object of the present invention is to provide a high-frequency relay that exhibits an excellent isolation characteristic.

In order to achieve the above-mentioned objects, there is provided according to one aspect of the present invention a high-frequency relay comprising: a body containing a contact unit connected with at least one contact terminal protruded from a bottom surface of the body, the contact unit having contact states switched according as an energization to a coil; and a base covering at least the bottom surface, the base having a grounding function and including a conductive layer.

According to the present invention, the high-frequency relay can exhibit an excellent isolation characteristic.

More preferably, in the high-frequency relay according to the present invention, the base may be formed in a box shape covering the bottom surface and four side surfaces of the body, the box shape having an upward opening.

More preferably, the high-frequency relay according to the present invention may further comprise an openable and closable lid member capable of being closed on the upward opening, the lid member including a conductive layer so as to be electrically connected with the base.

More preferably, the high-frequency relay according to the present invention may further comprise a cover capable of covering surfaces of the body except the bottom surface, the cover including a conductive layer so as to be electrically connected with the base.

In order to achieve the above-mentioned objects, there is also provided according to another aspect of the present invention a high-frequency relay comprising: a body containing a contact unit connected with at least one contact terminal protruded from a bottom surface of the body, the contact unit having contact states switched according as an energization to a coil; a cover capable of covering surfaces of the body except the bottom surface, the cover having a grounding function and including a conductive layer; and a base covering at least the bottom surface, the base including a conductive layer so as to be electrically connected with the cover.

More preferably, in the high-frequency relay according to the present invention, one of the base and the cover may include a ground terminal having the grounding function. Alternatively, the base may include a mounting pad so as to be mounted on a substrate, the mounting pad having the grounding function.

Additionally, in the high-frequency relay according to the present invention, the base may be composed of a resinous molding coated with the conductive layer.

More preferably, in the high-frequency relay according to the present invention, the base may include at least one insertion hole accommodating the contact terminal inserted therethrough.

More preferably, in the high-frequency relay according to the present invention, the base may be formed from a metal plate by bending so as to comprise a ground terminal bent from a bottom surface of the base and a defective part formed in the bottom surface of the base by bending the ground terminal; the cover may be formed from a metal plate by bending so as to comprise a foldable projection capable of being folded with respect to the cover; and the defective part may be closed by the foldable projection.

Additionally, in the high-frequency relay according to the present invention, the cover may be composed of a resinous molding coated with the conductive layer.

More preferably, in the high-frequency relay according to the present invention, the cover and the base may comprise respective engaging members so that the cover and the base are engaged by the engaging members so as to be unified.

Additionally, in the high-frequency relay according to the present invention, one of the cover and the base may be inserted into the other so as to be unified.

Additionally, in the high-frequency relay according to the present invention, the cover and the base may be bonded to each other so as to be unified.

In order to achieve the above-mentioned objects, there is also provided according to another aspect of the present invention a high-frequency relay comprising: a body containing a contact unit connected with a contact terminal and a ground terminal protruded from a bottom surface of the body, the contact unit having contact states switched according as an energization to a coil; a base covering at least the bottom surface, the base including a conductive layer so as to be electrically connected with the ground terminal; and a cover capable of covering surfaces of the body except the bottom surface, the cover including a conductive layer so as to be electrically connected with the base.

According to the present invention, the ground terminal or the pad need not be especially provided on the base or the cover.

In order to achieve the above-mentioned objects, there is also provided according to another aspect of the present invention a high-frequency relay comprising:

a body containing a contact unit connected with at least one contact terminal protruded from a bottom surface of the body, the contact unit having contact states switched according as an energization to a coil;

a base covering at least the bottom surface, the base including a conductive layer;

a cover capable of covering surfaces of the body except the bottom surface, the cover including a conductive layer;

a ground terminal formed on one of the base and the cover; and a standoff portion provided on one of the base and the cover.

According to the present invention, when the relay is mounted on a substrate, the base of the relay and a pattern formed on the substrate can surely be prevented from interfering with each other.

Other objects, features and advantages of the present invention will become more apparent from the following detailed description when read in conjunction with the accompanying drawings.

DETAILED DESCRIPTION OF THE PREFERRED EMBODIMENTS

A description will now be given, with reference to the drawings, of embodiments of a high-frequency relay (hereinafter simply referred to as a relay) according to the present invention.

It is noted here that, since each of the relays according to the following embodiments has the same basic structure as the foregoing conventional relays, the same elements will be referenced by the same reference marks, if not especially mentioned; or, as occasion demands, the elements will not be specifically referenced by the reference marks or will not be shown in the figures, and will not be described in detail.

Figure 1A:
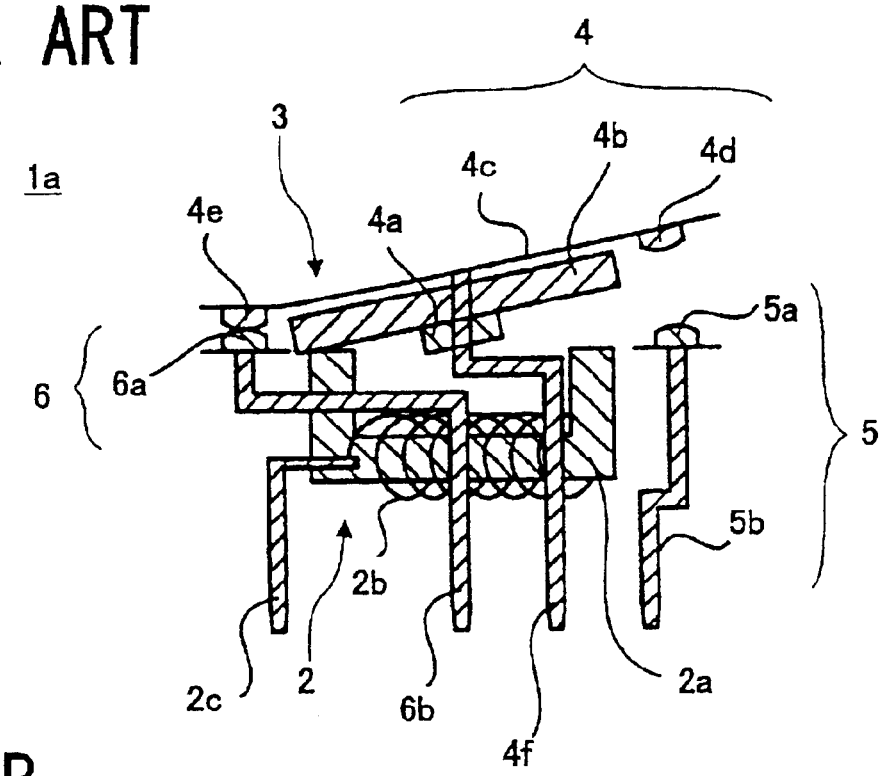
FIG. 1A PRIOR ART
FIG. 1A is a diagram roughly illustrating a structure of a conventional relay.
Figure 8A:
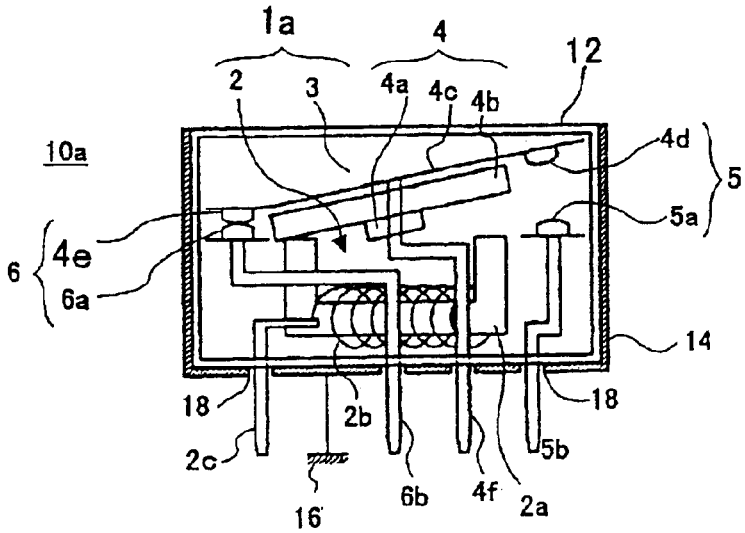
FIG. 8A is a diagram roughly illustrating a structure of a relay according to a first embodiment of the present invention.
Figure 8B:
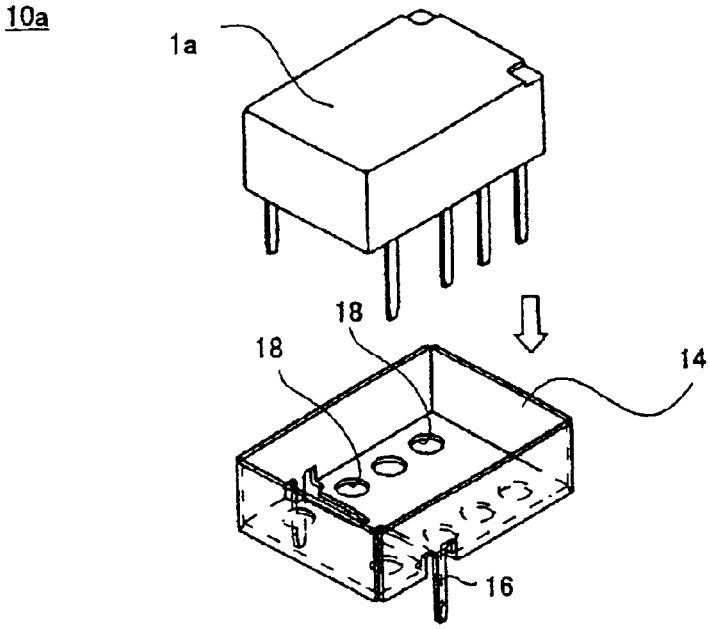
FIG. 8B is an exploded perspective view of the relay shown in FIG. 8A.
Figure 8C:
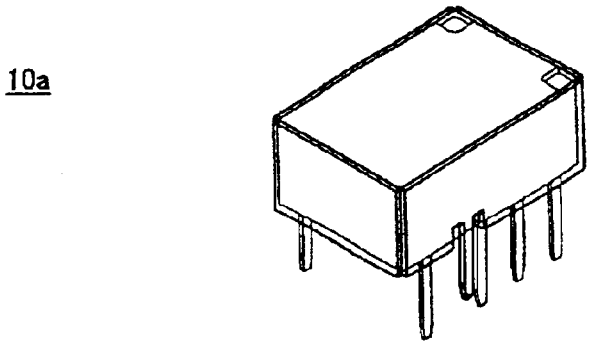
FIG. 8C is a perspective view of the relay shown in FIG. 8A.

As shown in FIG. 8A to FIG. 8C, a relay 10*a* according to a first embodiment of the present invention is a relay in which the present invention is applied to the conventional relay 1*a* shown in FIG. 1A.

The relay 10*a* comprises the body 1*a* of the relay, and a metal base 14. The body 1*a* contains the contact unit 3 in which the contact (make/break) state switches according as an energization to the coil 2*b*. The contact terminals 4*f*, 5*b* and 6*b* connected to the contact unit 3, and the coil terminal 2*c*, are protruded from a bottom surface of a resinous cover 12 covering these elements. The metal base 14 is formed in a box shape covering a bottom surface and four sides of the body 1*a* and opening upward. Ground terminals 16 realizing a grounding function are mounted on the base 14. The ground terminals 16 are terminals inserted into through holes of a substrate not shown in the figure. Insertion holes 18 are formed in a bottom surface of the base 14. The terminals 2*c*, 4*f*, 5*b* and 6*b* of the body 1*a* are inserted through the respective insertion holes 18.

The relay 10*a* according to the present first embodiment exhibits an excellent isolation characteristic.

Figure 9:
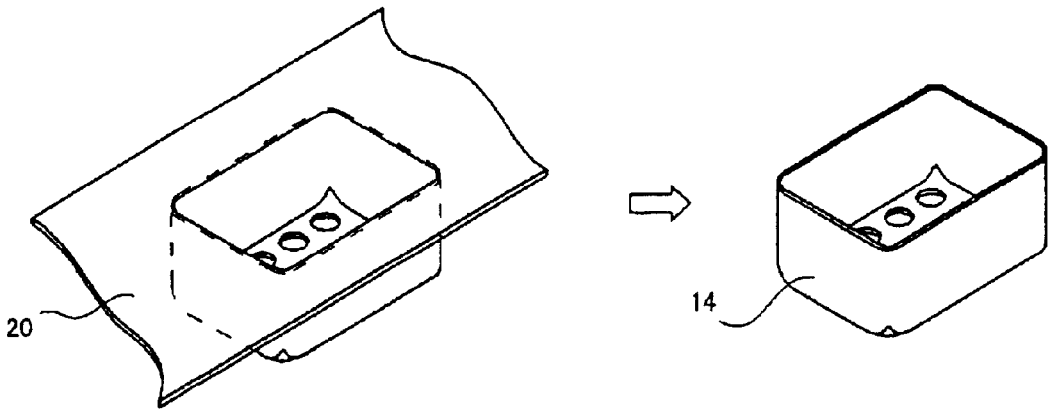
FIG. 9 is a diagram for explaining a method for forming a base shown in FIG. 8A to FIG. 8C from a metal plate by deep drawing.
Figure 10:
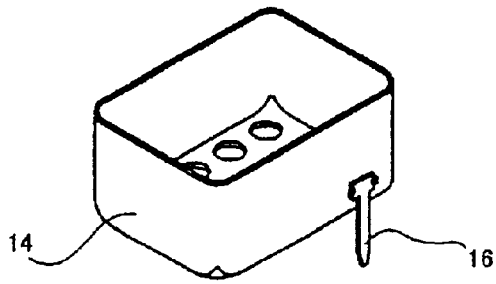
FIG. 10 is a diagram of the base shown in FIG. 9 with ground terminals mounted thereto.

The base 14 of the relay 10*a* according to the present first embodiment can be formed from a metal plate 20 into the box shape by deep drawing, for example as shown in FIG. 9. Then, for example as shown in FIG. 10, the ground terminals 16 are mounted on the metal base 14 by welding. In this case, each of five planes of the base 14 formed by deep drawing has no gaps; this contributes to improving the isolation characteristic.

Figure 11:
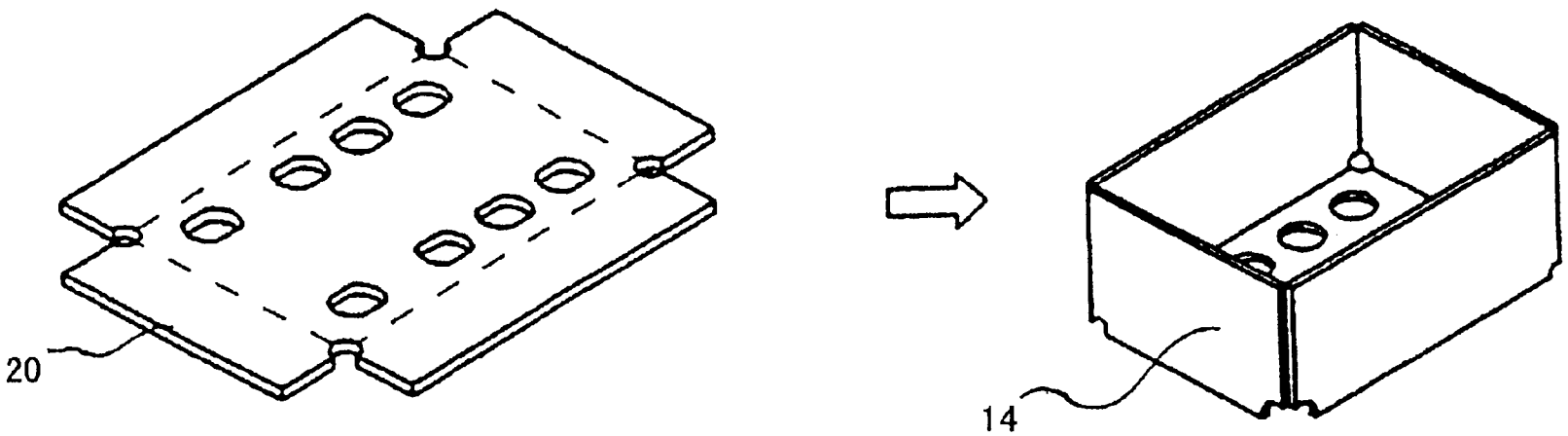
FIG. 11 is a diagram for explaining a method for forming the base shown in FIG. 8A to FIG. 8C from a metal plate by bending.

Alternatively, the base 14 of the relay 10*a* can be formed from the metal plate 20 into the box shape by bending, for example as shown in FIG. 11. Then, the ground terminals 16 are mounted on the metal base 14 by welding, in the same manner as in FIG. 10.

Figure 12:
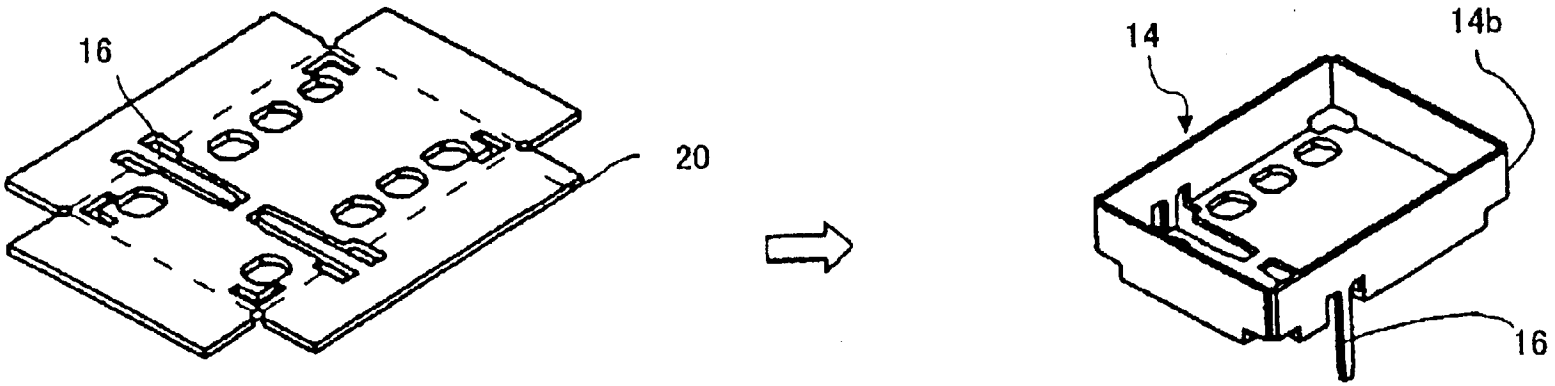
FIG. 12 is a diagram for explaining a method for forming the base shown in FIG. 8A to FIG. 8C by bending a metal plate provided with ground terminals.
Figure 13:
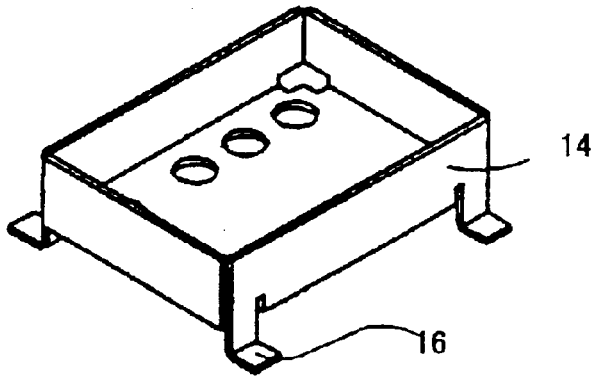
FIG. 13 is a diagram for explaining another form of ground terminals different from the ground terminals shown in FIG. 12.
Figure 14:
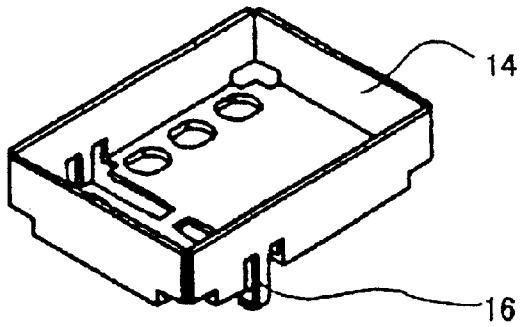
FIG. 14 is a diagram for explaining still another form of ground terminals different from the ground terminals shown in FIG. 12 and FIG. 13.

In this course, for example as shown in FIG. 12, the ground terminals 16 may be formed beforehand unitarily with the metal plate 20 so that starting portions of the ground terminals 16 are located at parts of the metal plate 20 corresponding to sides of the base 14. With this arrangement, at the same time that sides 14*b* of the base 14 are formed by bending up the parts of the metal plate 20 corresponding to the sides of the base 14, the ground terminals 16 are so formed as to hang down from the sides 14*b*. Additionally, the ground terminals 16 may be formed as surface mount terminals by bending end portions of the ground terminals 16 outwardly as shown in FIG. 13, or by bending the end portions of the ground terminals 16 inwardly as shown in FIG. 14.

Figure 15:
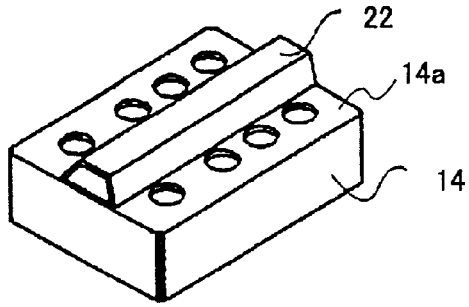
FIG. 15 is a diagram for explaining a form of the base provided with a projection formed as a pad.
Figure 16:
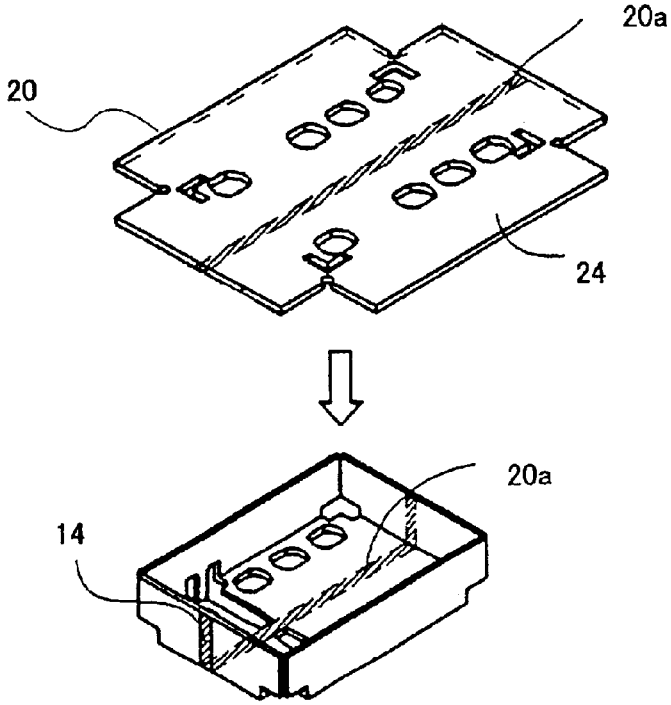
FIG. 16 is a diagram for explaining a form of the base provided with a conductive portion formed as a pad.

Alternatively as a structure having a grounding function, a line of projection 22 may be formed as a pad (a ground connection portion) on a bottom surface 14*a* of the base 14, as shown in FIG. 15. Still alternatively, an insulating coating 24 may be applied throughout the surface of the metal plate 20 except a line of conductive portion 20*a* to be left as a pad (a ground connection portion) on the metal plate 20, as shown in FIG. 16.

Figure 17:
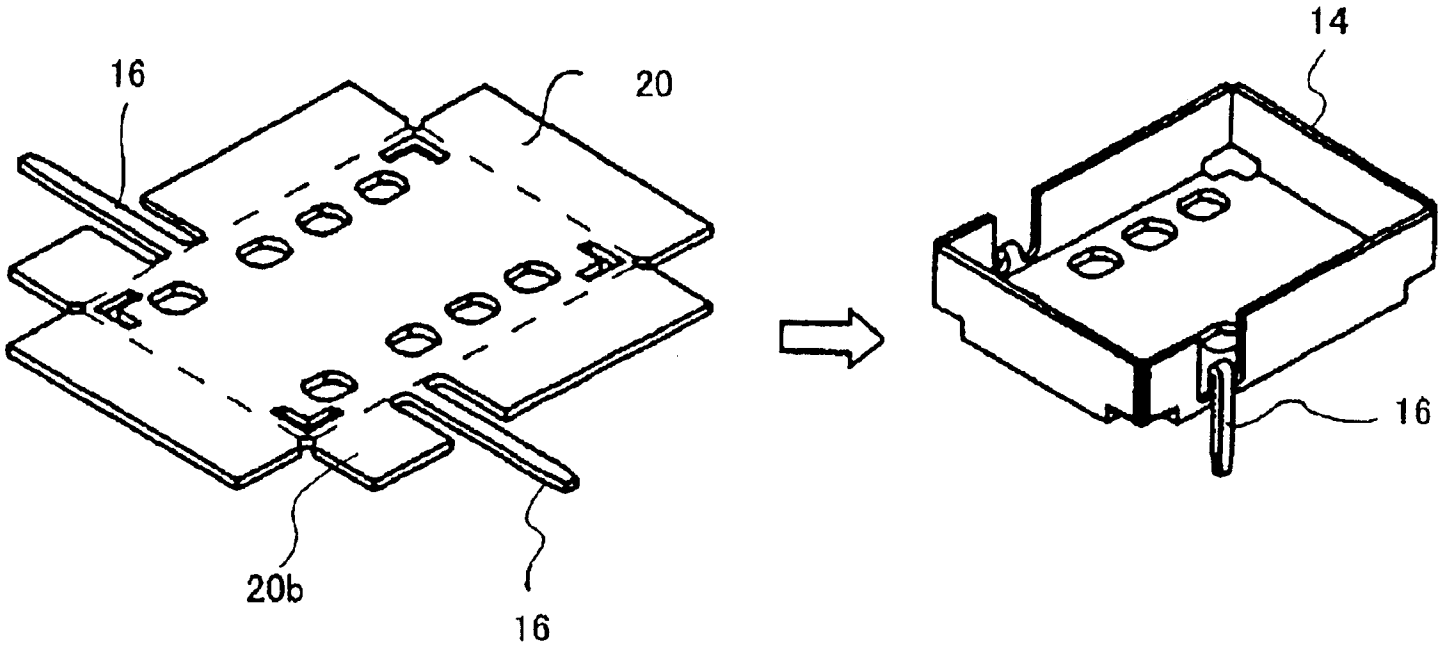
FIG. 17 is a diagram for explaining still another form of ground terminals.
Figure 18:
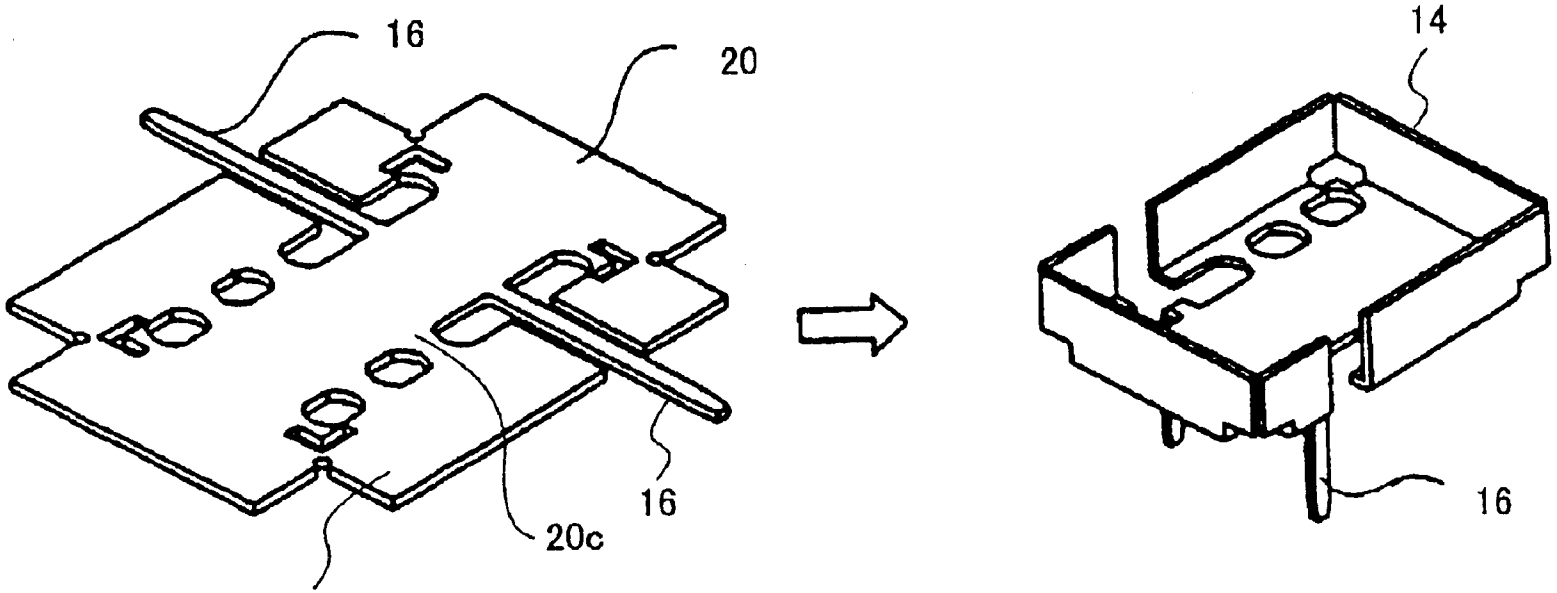
FIG. 18 is a diagram for explaining still another form of ground terminals.

Additionally, the ground terminals 16 may be formed by being bent from the metal plate 20. For example, as shown in FIG. 17, the ground terminals 16 may be formed long at bent-up parts (parts of the metal plate 20 to become the sides of the base 14) 20*b*. Then, after the bent-up parts 20*b* are bent up together with the ground terminals 16, the ground terminals 16 alone may be bent down so at to become substantially U-shaped. Alternatively, as shown in FIG. 18, the ground terminals 16 may be formed long unitarily with the metal plate 20 with starting portions of the ground terminals 16 being located at a part 20*c* of the metal plate 20 to become the bottom surface 14*a* of the base 14. Then, whereas the bent-up parts 20*b* are bent up, the ground terminals 16 may be bent down oppositely.

Figure 19A:
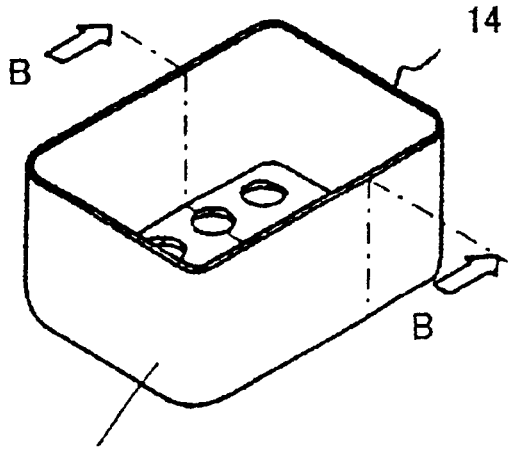
FIG. 19A and FIG. 19B are diagrams for explaining a method for forming the base including a box member molded from a resin.
Figure 19B:
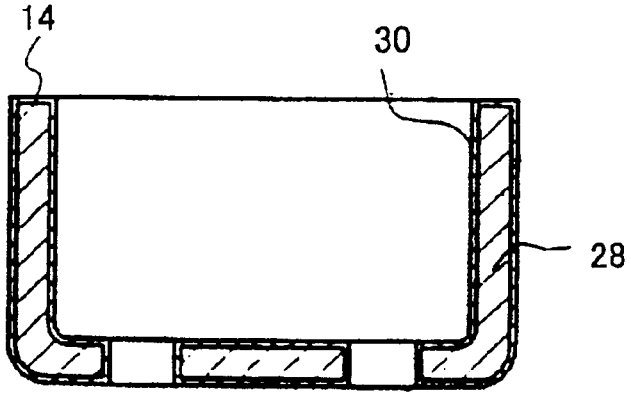

Still alternatively, the base 14 of the relay 10*a* may be formed as follows: a box member 28 is formed by molding a resin; and a metal film (a conductive layer) 30 is formed on the surface of the box member 28 by plating or coating the surface of the box member 28, as shown in FIG. 19A and FIG. 19B. Then, the ground terminals 16 are mounted on the metal base 14 by welding, in the same manner as in FIG. 10, for example.

Figure 20:
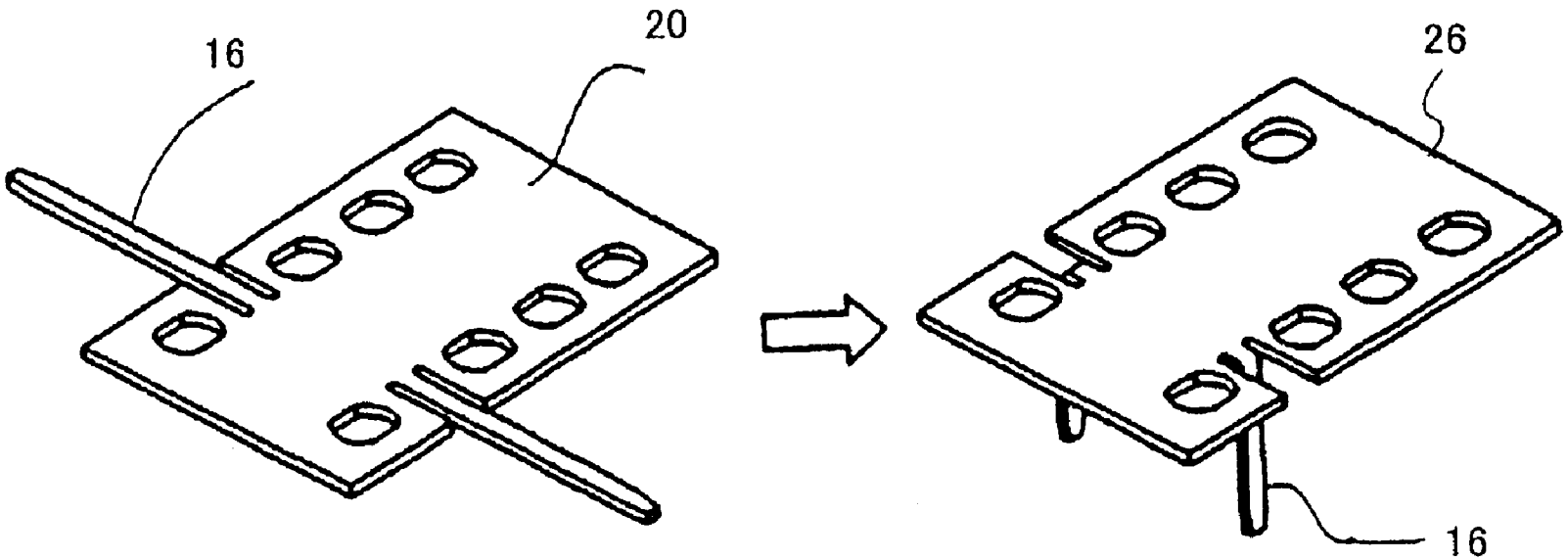
FIG. 20 is a perspective view of a base of a relay according to a second embodiment of the present invention, the base being provided with ground terminals.
Figure 21:
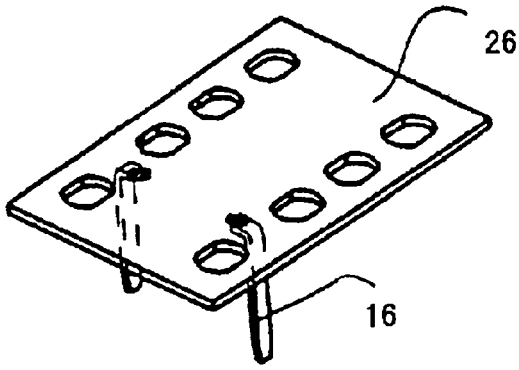
FIG. 21 is a perspective view of the base shown in FIG. 20 provided with another form of ground terminals different from the ground terminals shown in FIG. 20.
Figure 22:
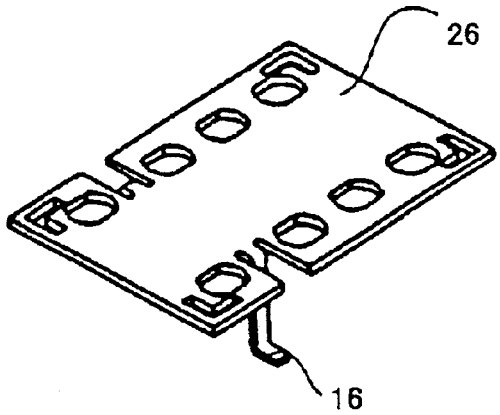
FIG. 22 is a perspective view of the base shown in FIG. 20 provided with still another form of ground terminals.
Figure 23:
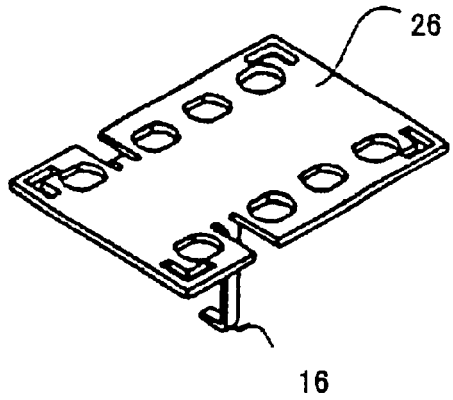
FIG. 23 is a perspective view of the base shown in FIG. 20 provided with still another form of ground terminals.
Figure 24A:
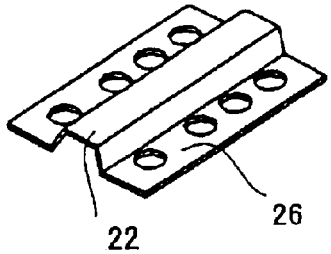
FIG. 24A is a perspective view of a form of the base provided with a projection formed as a pad.
Figure 24B:
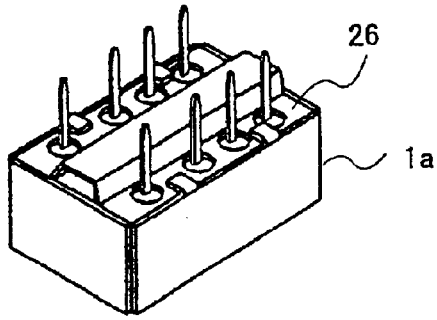
FIG. 24B is a perspective view of the base shown in FIG. 24A attached to a body of the relay according to the second embodiment of the present invention.
Figure 25:
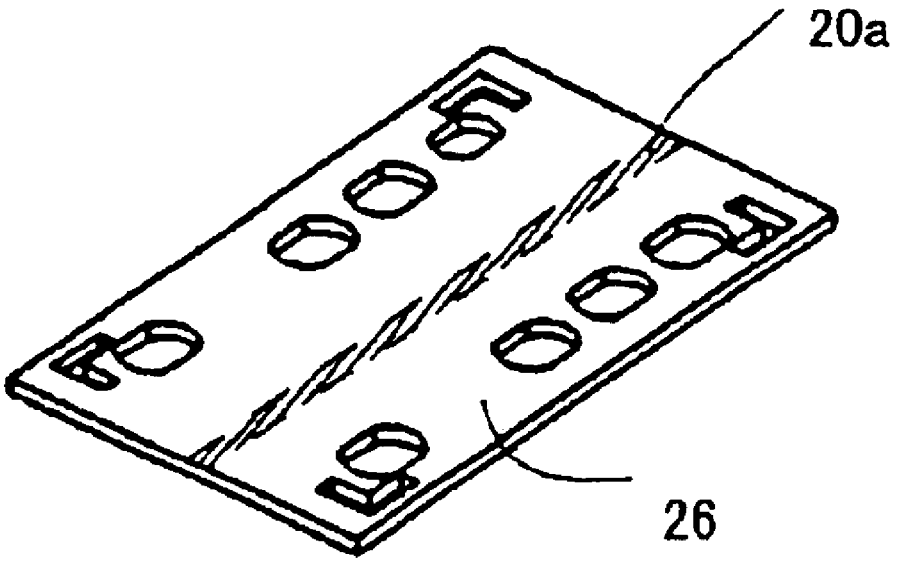
FIG. 25 is a diagram for explaining a form of the base provided with a conductive portion formed as a pad.

Next, a relay according to a second embodiment of the present invention is different from the relay 10*a* according to the foregoing first embodiment in that the metal base 14 formed in the box shape is replaced by a base 26 formed in a shape having a bottom plate (a bottom surface) alone. Additionally, for example, the ground terminals 16 may be formed as shown in FIG. 20 corresponding to FIG. 18. Still additionally, for example, the ground terminals 16 may be welded on the base 26, as shown in FIG. 21. Still additionally, the ground terminals 16 may be formed as surface mount terminals by bending the end portions of the ground terminals 16 outwardly as shown in FIG. 22 corresponding to FIG. 13, or by bending the end portions of the ground terminals 16 inwardly as shown in FIG. 23 corresponding to FIG. 14. Further, the projection 22 may be formed as a pad (a ground connection portion), as shown in FIG. 24A and FIG. 24B corresponding to FIG. 15. Still further, the conductive portion 20*a* may be formed as a pad (a ground connection portion), as shown in FIG. 25 corresponding to FIG. 16.

As described above, the relay according to the present second embodiment has a simple structure that can provide a substantially equivalent advantage to the advantage provided by the relay 10*a* according to the foregoing first embodiment.

Figure 26A:
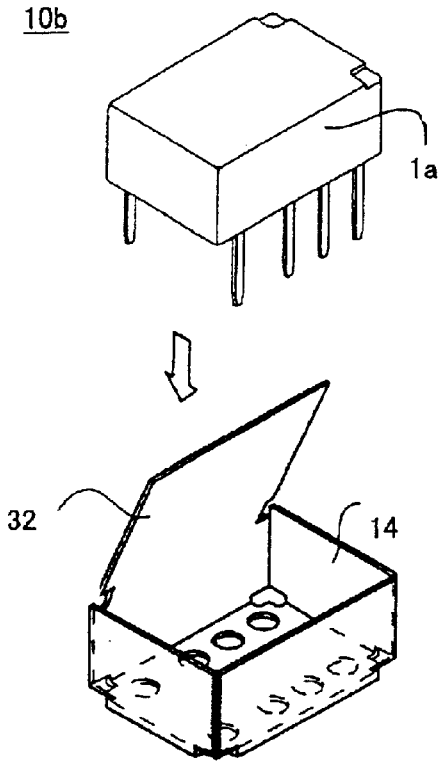
FIG. 26A is an exploded perspective view of a relay according to a third embodiment of the present invention.
Figure 26B:
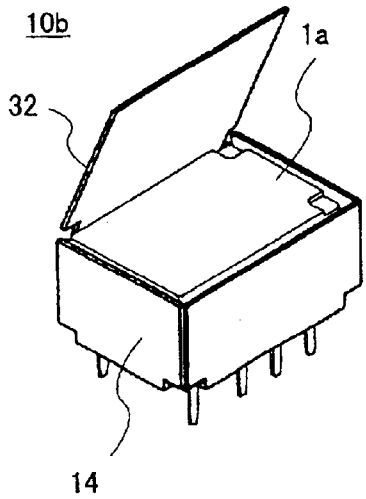
FIG. 26B is a perspective view of the relay with a lid member yet to be closed.
Figure 26C:
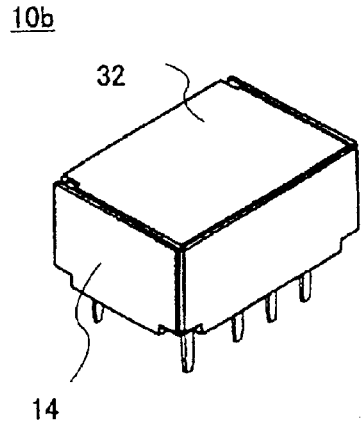
FIG. 26C is a perspective view of the relay with the lid member closed.

Next, a relay 10*b* according to a third embodiment of the present invention has a structure in which an openable and closable lid member 32 is provided on one of the sides 14*b* of the base 14, as shown in FIG. 26A to FIG. 26C, in addition to the structure of the relay 10*a* according to the foregoing first embodiment. The lid member 32 includes a conductive layer, such as a metal film, and is electrically connected with the base 14. After the body 1*a* is contained in the base 14 formed in the box shape, as shown in FIG. 26A and FIG. 26B, the lid member 32 is closed so as to shut the upward opening; thereby, the body 1*a* is covered tightly with the base 14 and the lid member 32, as shown in FIG. 26C.

The relay 10*b* according to the present third embodiment exhibits a more excellent isolation characteristic than the relay 10*a* according to the foregoing first embodiment.

Figure 27A:
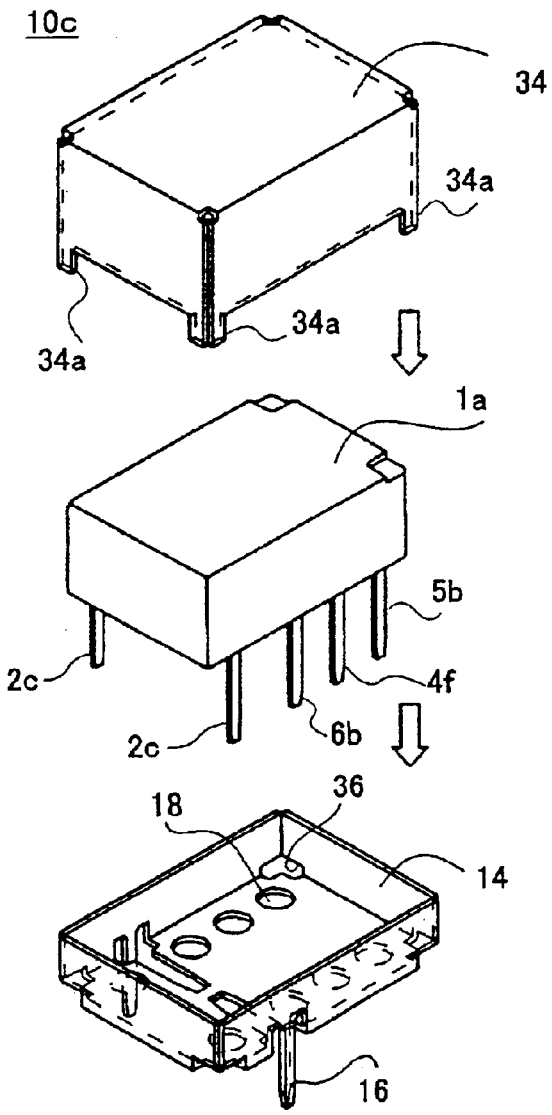
FIG. 27A is an exploded perspective view of a relay according to a fourth embodiment of the present invention.
Figure 27B:
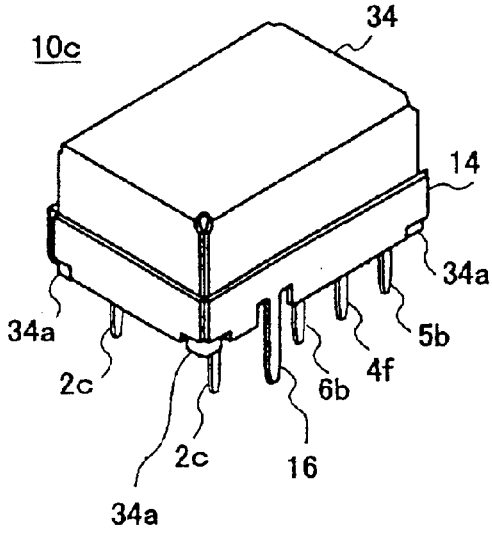
FIG. 27B is a perspective view of an assembly of the relay shown in FIG. 27A.

Next, a relay 10*c* according to a fourth embodiment of the present invention comprises a metal cover 34 formed in a box shape opening downward, as shown in FIG. 27A and FIG. 27B, together with the base 14 of the relay 10*a* according to the foregoing first embodiment.

The cover 34 has standoff portions 34*a* at four corners of lower edges of sides thereof. On the other hand, holes 36 are so formed in the base 14 that the standoff portions 34*a* pass through the respective holes 36.

After the body 1*a* is contained in the base 14, the cover 34 is inserted along inner side surfaces of the base 14. In this course, the standoff portions 34*a* are inserted through the respective holes 36. Thereby, the body 1*a* is covered tightly with the base 14 and the cover 34.

The relay 10*c* according to the present fourth embodiment provides a similar advantage to the advantage provided by the relay 10*b* according to the foregoing third embodiment. Additionally, when the relay 10*c* is mounted on the substrate not shown in the figure by inserting the terminals through the through holes of the substrate to protrude from the undersurface of the substrate, the standoff portions 34*a* provided in the relay 10*c* can surely prevent the base 14 and a pattern formed on the substrate from interfering with each other, because the standoff portions 34*a* contact the upper surface of the substrate so as to create a gap between the relay 10*c* and the substrate. (This point will be hereinafter described in detail with reference to FIG. 48A to FIG. 48C.)

Additionally, in the relay 10*c,* the ground terminals 16 may be formed on the cover 34, instead of being formed on the base 14, such that the ground terminals 16 pass through holes formed in the base 14 (not shown in the figures). Additionally, the standoff portions 34*a* may be formed on the base 14.

Figure 28:
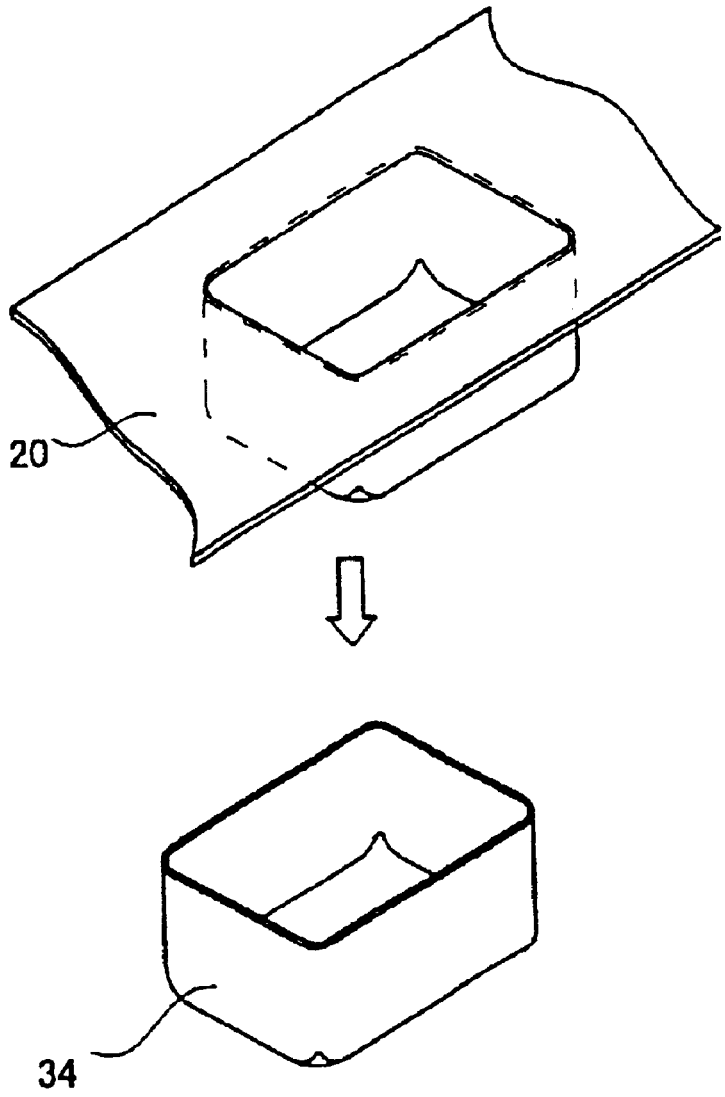
FIG. 28 is a diagram for explaining a method for forming a cover shown in FIG. 27A and FIG. 27B from a metal plate by deep drawing.
Figure 29:
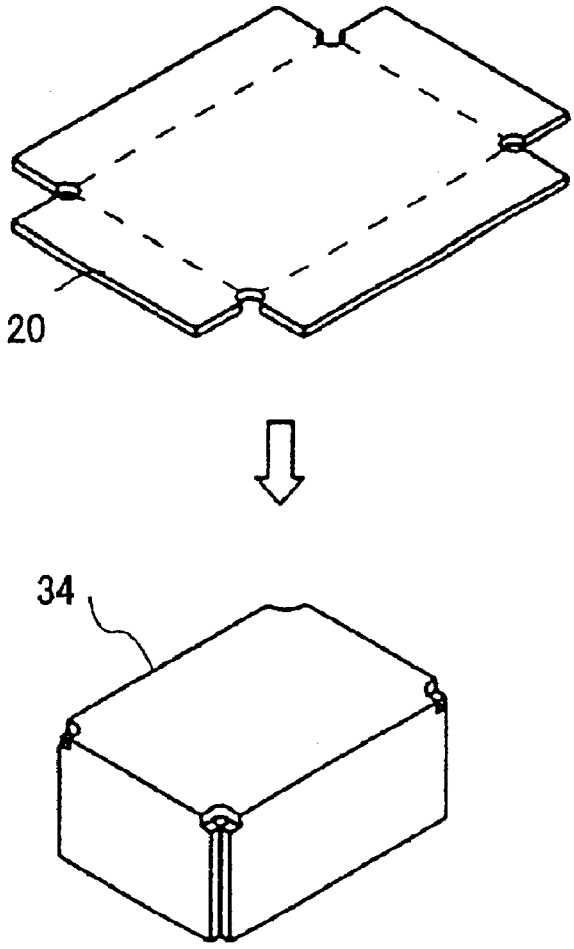
FIG. 29 is a diagram for explaining a method for forming the cover shown in FIG. 27A and FIG. 27B from a metal plate by bending.

The cover 34 of the relay 10*c* according to the present fourth embodiment can be formed from the metal plate 20 by deep drawing, for example as shown in FIG. 28. Alternatively, the cover 34 can be formed from the metal plate 20 by bending, for example as shown in FIG. 29.

Figure 30A:
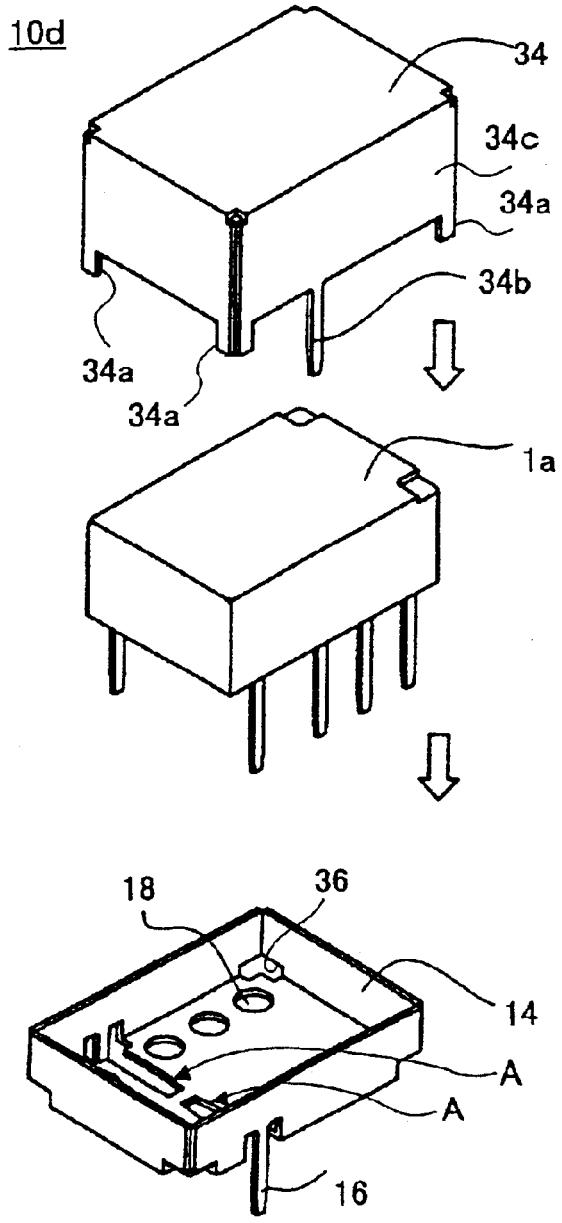
FIG. 30A is an exploded perspective view of a relay according to a fifth embodiment of the present invention.
Figure 30B:
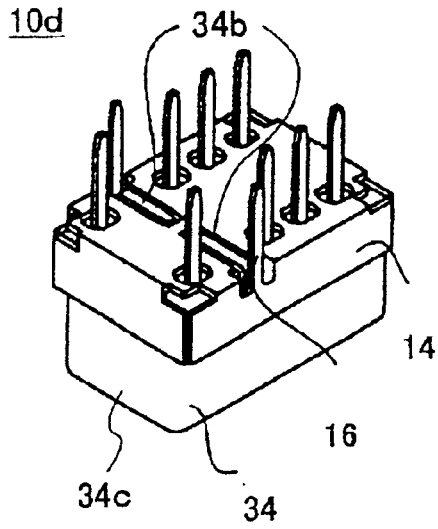
FIG. 30B is an inverted perspective view of an assembly of the relay shown in FIG. 30A.

Next, as shown in FIG. 30A and FIG. 30B, a relay 10*d* according to a fifth embodiment of the present invention has substantially the same structure as the relay 10*c* according to the foregoing fourth embodiment, but is different from the relay 10*c* in that long foldable projections 34*b* are provided on opposing sides 34*c* of the cover 34.

Each of the base 14 and the cover 34 is formed from the metal plate by bending, and the ground terminals 16 of the base 14 are bent from the metal plate. In this course, bending the ground terminals 16 leaves defective parts, i.e., openings (indicated by arrows A in FIG. 30A) in the bottom surface 14*a* of the base 14. However, when the cover 34 containing the body 1*a* is inserted into the base 14, the foldable projections 34*b* are bent inwardly so that the openings A are closed by the foldable projections 34*b*. Thereby, the body 1*a* can be covered more tightly.

Figure 31:
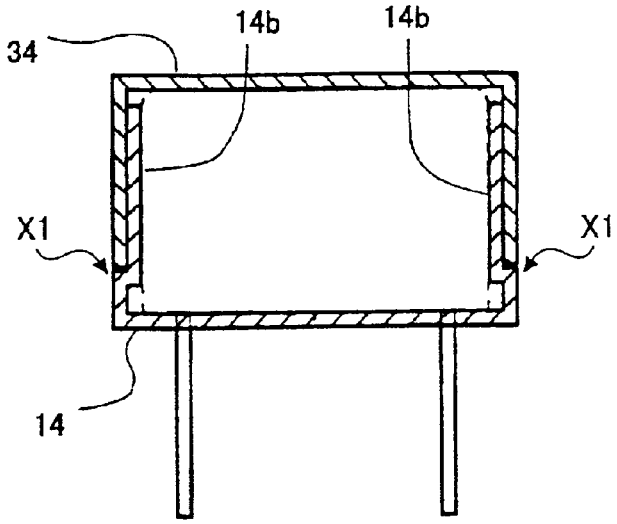
FIG. 31 is a diagram of an example of insertion structures of the base and the cover according to the present invention.
Figure 32:
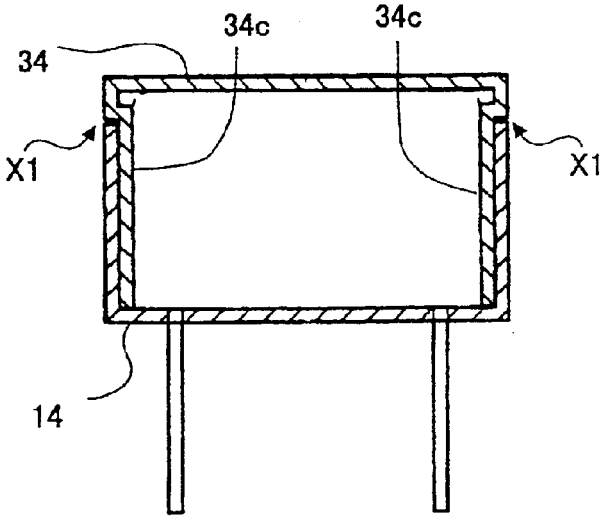
FIG. 32 is a diagram of another example of insertion structures of the base and the cover according to the present invention.

Besides, in the heretofore-described embodiments, the base and the cover are unified by using insertion methods and structures. As such insertion structures, it is more preferable that the sides 14*b* of the base 14 to be inserted into the cover 34 are so formed as to have steps (indicated by arrows X1) near lower ends of the sides 14*b,* as shown in FIG. 31, or that the sides 34*c* of the cover 34 to be inserted into the base 14 are so formed as to have steps (indicated by arrows X1) near upper ends of the sides 34*c,* as shown in FIG. 32. Accordingly, upon insertion of the base/the cover, the steps function as stoppers so as to accurately position the base and the cover.

Here, descriptions will be given, with reference to FIG. 33A to FIG. 37B, of other methods and structures for unifying the base and the cover by using respective engaging members.

Figure 33A:
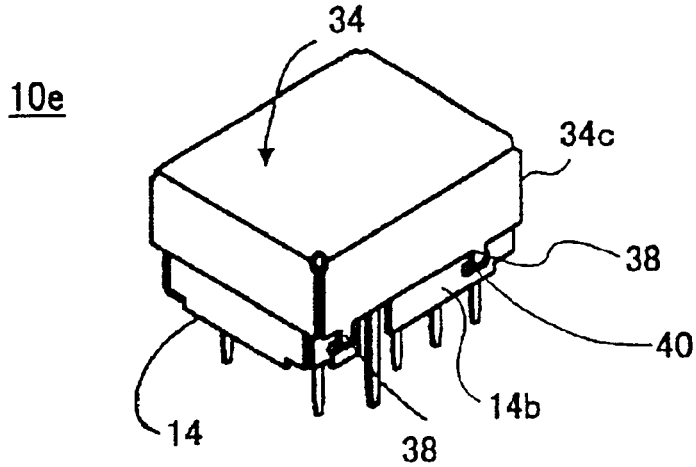
FIG. 33A and FIG. 33B are diagrams of an example of engaging structures for the base and the cover according to the present invention, using engaging members.
Figure 33B:
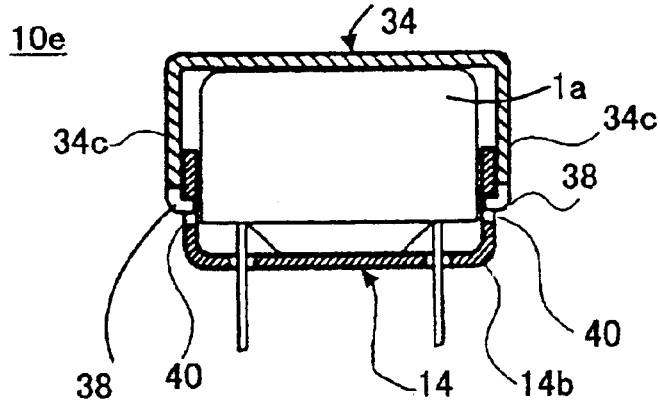

In a relay 10*e* shown in FIG. 33A and FIG. 33B, a plurality of hooks 38 are provided on lower edges of the sides 34*c* of the cover 34, and a plurality of holes 40 are formed in the sides 14*b* of the base 14.

In the course of unifying the base and the cover of the relay 10*e,* after the body 1*a* is contained in the base 14, the cover 34 is put on the base 14 with the hooks 38 contacting smoothly on the sides 14*b;* then, the hooks 38 engage the holes 40 so as to fix the cover 34 to the base 14 unitarily.

Figure 34A:
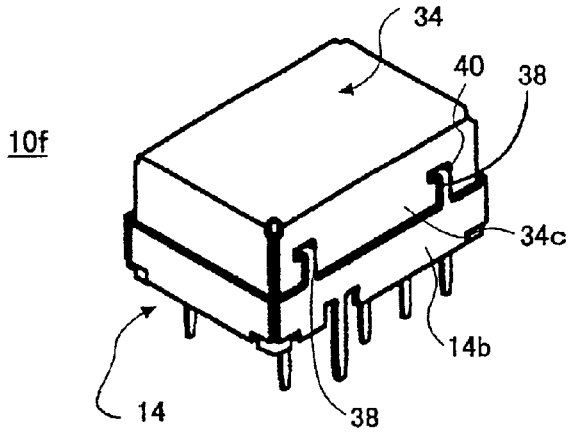
FIG. 34A and FIG. 34B are diagrams of another example of engaging structures for the base and the cover according to the present invention.
Figure 34B:
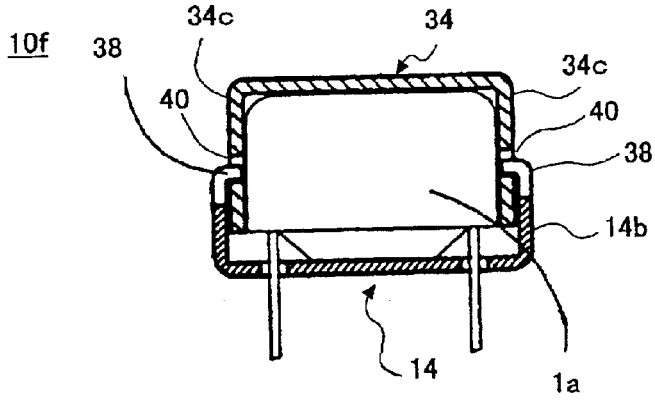

In a relay 10*f* shown in FIG. 34A and FIG. 34B, the holes 40 are formed in the sides 34*c* of the cover 34, and the hooks 38 are provided on upper edges of the sides 14*b* of the base 14, contrary to the relay 10*e.*

In the course of unifying the base and the cover of the relay 10*f,* the cover 34 containing the body 1*a* is inserted into the base 14 with the hooks 38 contacting smoothly on the sides 34*c;* then, the hooks 38 engage the holes 40 so as to fix the cover 34 to the base 14 unitarily.

Figure 35A:
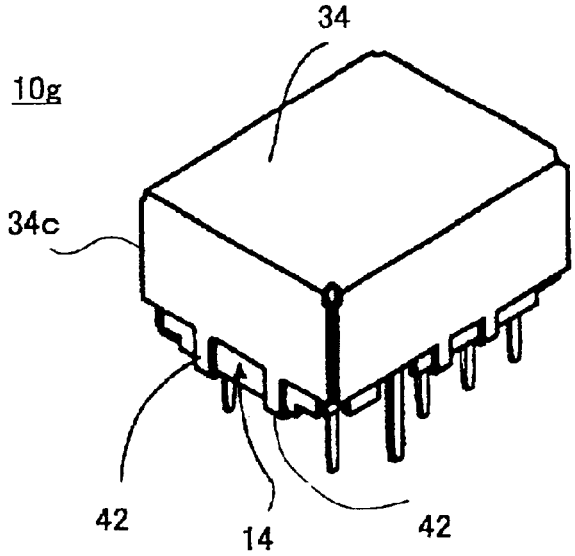
FIG. 35A and FIG. 35B are diagrams of still another example of engaging structures for the base and the cover according to the present invention.
Figure 35B:
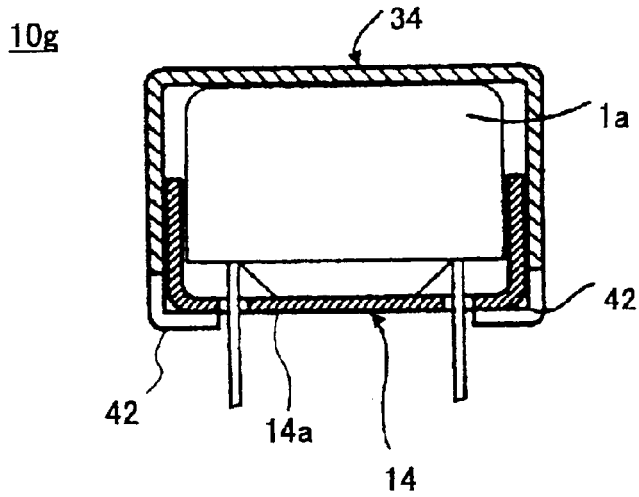

In a relay 10*g* shown in FIG. 35A and FIG. 35B, a plurality of foldable long projections (terminals) 42 are provided on the lower edges of the sides 34*c* of the cover 34.

In the course of unifying the base and the cover of the relay 10*g,* after the body 1*a* is contained in the base 14, the cover 34 is put on the base 14, and then, the long projections 42 are bent inwardly so as to engage the bottom surface 14*a* of the base 14; thereby, the cover 34 is fixed to the base 14 unitarily.

Figure 36A:
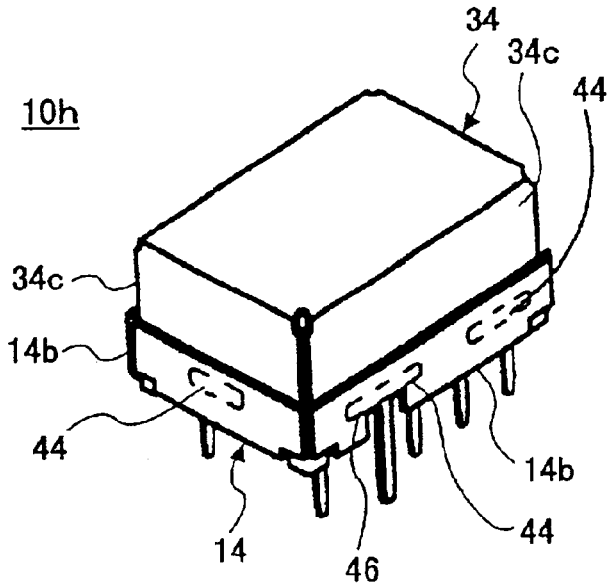
FIG. 36A and FIG. 36B are diagrams of still another example of engaging structures for the base and the cover according to the present invention.
Figure 36B:
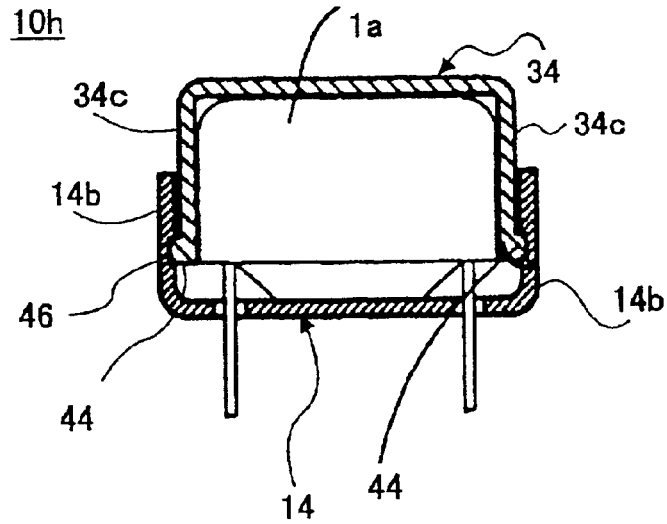

In a relay 10*h* shown in FIG. 36A and FIG. 36B, a plurality of belt-shaped projections 44 are provided on outer surfaces of the sides 34*c* of the cover 34, and a plurality of belt-shaped holes 46 are provided on inner surfaces of the sides 14*b* of the base 14.

In the course of unifying the base and the cover of the relay 10*h,* the cover 34 containing the body 1*a* is inserted into the base 14 with the belt-shaped projections 44 of the cover 34 contacting smoothly on inner surfaces of the sides 14*b* of the base 14 until the belt-shaped projections 44 engage the belt-shaped holes 46; thereby, the cover 34 is fixed to the base 14 unitarily.

Figure 37A:
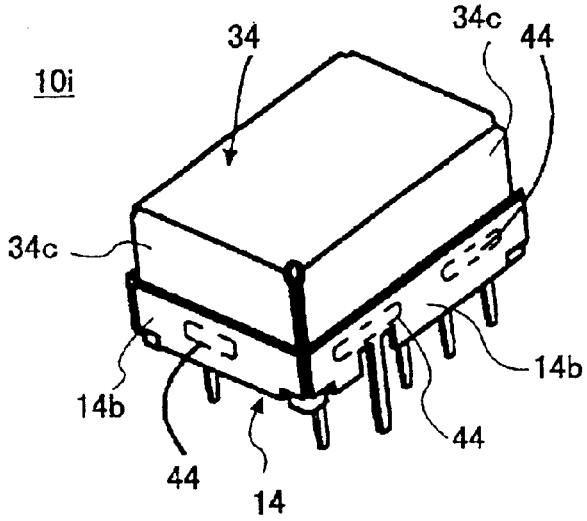
FIG. 37A and FIG. 37B are diagrams of still another example of engaging structures for the base and the cover according to the present invention.
Figure 37B:
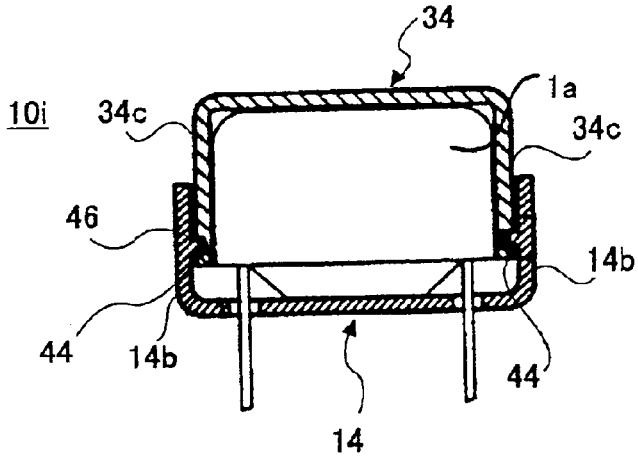

In a relay 10*i* shown in FIG. 37A and FIG. 37B, the belt-shaped holes 46 are provided on the outer surfaces of the sides 34*c* of the cover 34, and the belt-shaped projections 44 are provided on the inner surfaces of the sides 14*b* of the base 14, contrary to the relay 10*h.*

In the course of unifying the base and the cover of the relay 10*i,* the cover 34 containing the body 1*a* is inserted into the base 14 with the sides 34*c* of the cover 34 contacting smoothly on the belt-shaped projections 44 of the base 14 until the belt-shaped projections 44 engage the belt-shaped holes 46; thereby, the cover 34 is fixed to the base 14 unitarily.

Besides, in the heretofore-described embodiments, the body of the relay is contained in and unified with the base or the cover by using insertion methods and structures. Here, descriptions will be given, with reference to FIG. 38A to FIG. 39B, of other methods and structures for containing and unifying the body of the relay in/with the base or the cover.

Figure 38A:
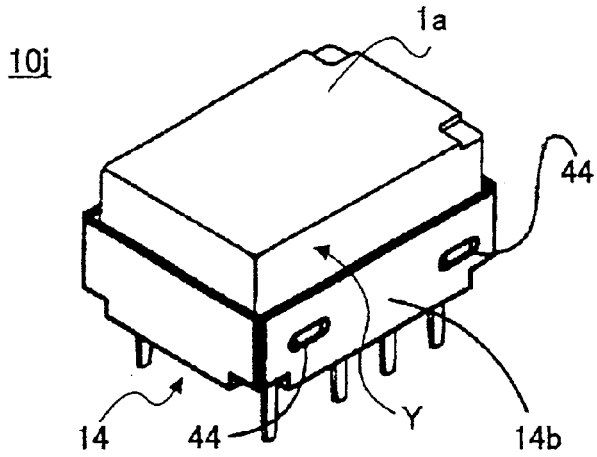
FIG. 38A and FIG. 38B are diagrams of an example of engaging structures for the base and the body according to the present invention, using engaging members.
Figure 38B:
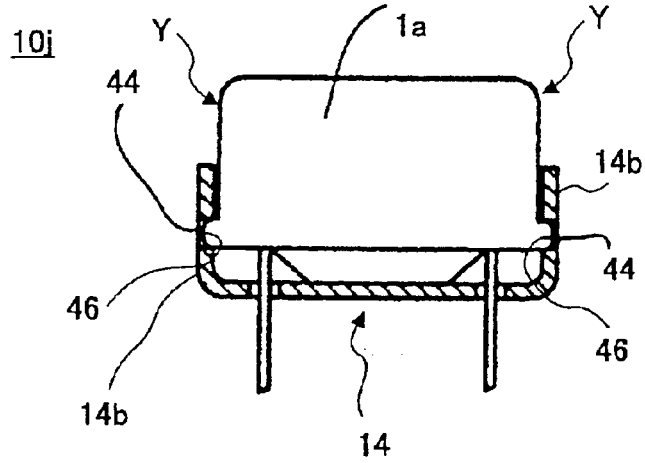

In a relay 10*j* shown in FIG. 38A and FIG. 38B, the belt-shaped projections 44 are provided on outer side surfaces (indicated by arrows Y) of the body 1*a,* and the belt-shaped holes 46 are provided on the inner surfaces of the sides 14*b* of the base 14.

In the course of containing and unifying the body in/with the base of the relay 10*j,* the body 1*a* is inserted into the base 14 with the belt-shaped projections 44 of the body 1*a* pushing open the sides 14*b* of the base 14 until the belt-shaped projections 44 engage the belt-shaped holes 46; thereby, the body 1*a* is contained in and unified with the base 14.

Figure 39A:
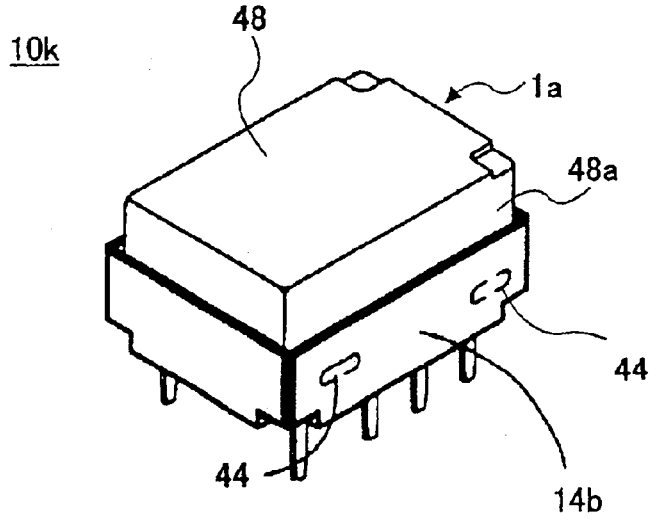
FIG. 39A and FIG. 39B are diagrams of another example of engaging structures for the base and the body according to the present invention.
Figure 39B:
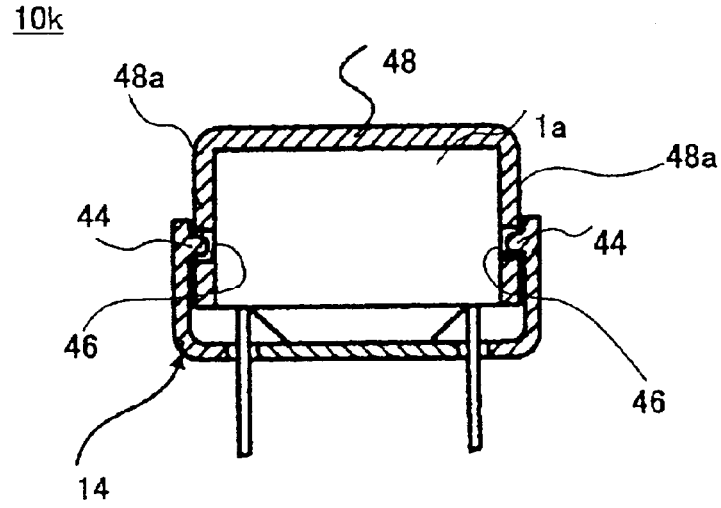

In a relay 10*k* shown in FIG. 39A and FIG. 39B, the body 1*a* is covered with a resinous cover 48, and the belt-shaped holes 46 are provided on outer surfaces of sides 48*a* of the resinous cover 48. The belt-shaped projections 44 are provided on the inner surfaces of the sides 14*b* of the base 14.

In the course of containing and unifying the body in/with the base of the relay 10*k,* the body 1*a* is inserted into the base 14 with the sides 48*a* of the resinous cover 48 of the body 1*a* pushing open the sides 14*b* of the base 14 with the belt-shaped projections 44 of the base 14 located therebetween until the belt-shaped projections 44 engage the belt-shaped holes 46; thereby, the body 1*a* is contained in and unified with the base 14.

Further, descriptions will be given, with reference to FIG. 40 to FIG. 41C, of methods and structures for fixing and unifying the base, the cover and the body of the relay all at one time.

Figure 40:
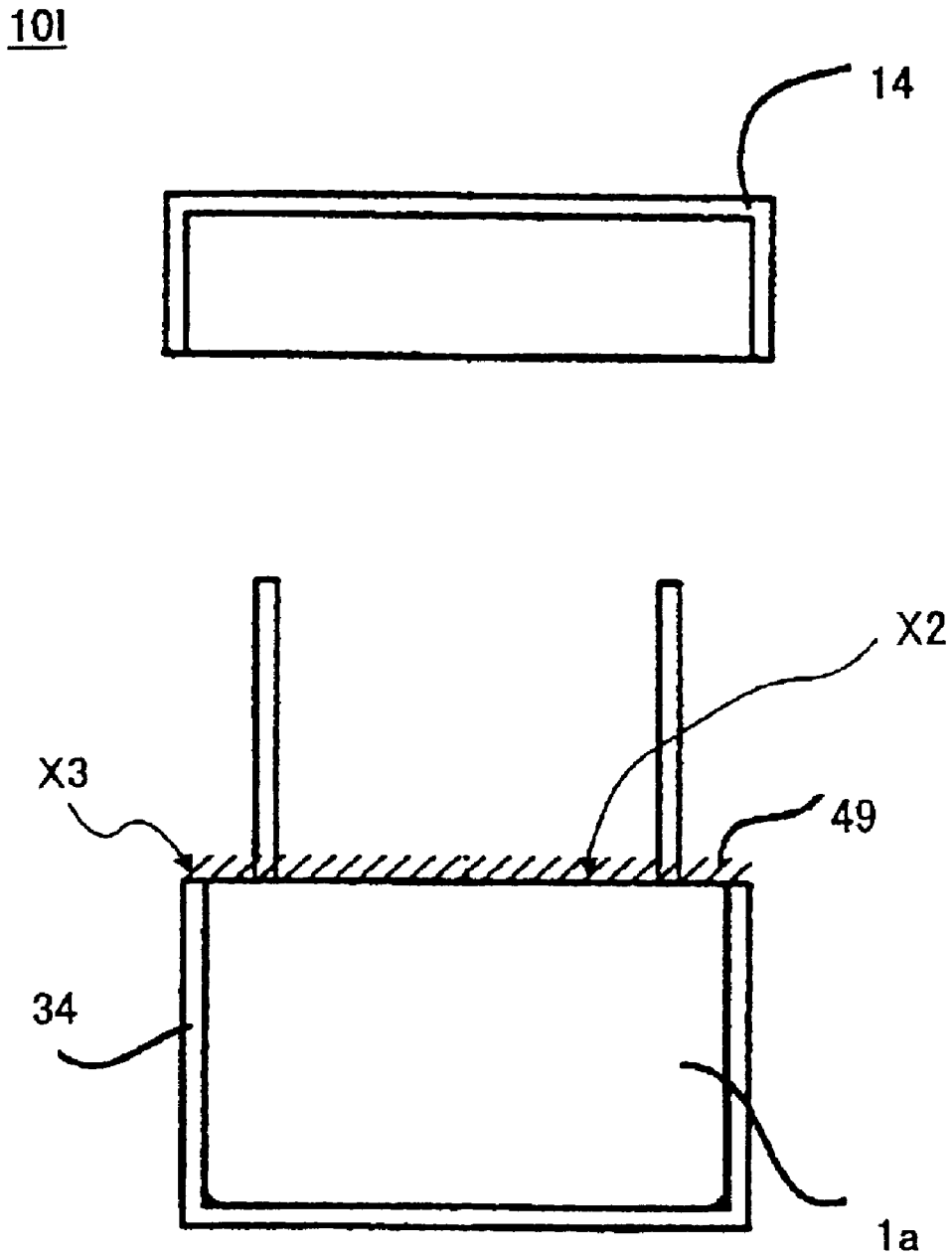
FIG. 40 is a diagram for explaining a method for unifying the base, the cover and the body of the relay by using a liquid adhesive.

The base 14, the cover 34 and the body 1*a* of a relay 101 shown in FIG. 40 are fixed and unified all at one time, as follows: in a state where the body 1*a* is contained in the cover 34, an epoxy-based liquid adhesive 49, for example, is applied on the bottom surface (indicated by arrow X2) of the body 1*a* and on peripheral parts (indicated by arrow X3) of the cover 34 in the vicinity of the bottom surface of the body 1*a,* and thereafter, the base 14 is put on the cover 34. Accordingly, the bottom surface of the body 1*a* and the peripheral parts of the cover 34 are bonded to inner surfaces of the bottom of the base 14 so that the base 14, the cover 34 and the body 1*a* are fixed and unified. This structure necessitates no particular engaging structure.

Figure 41A:
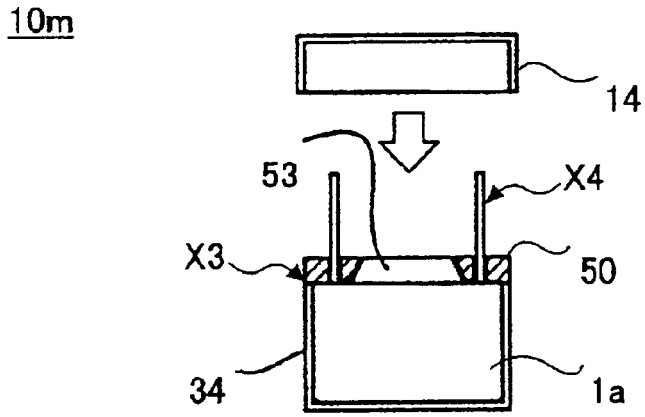
FIG. 41A is an exploded perspective view of the relay seen from one side, which explains a method for unifying the base, the cover and the body of the relay by using a solid adhesive.
Figure 41B:
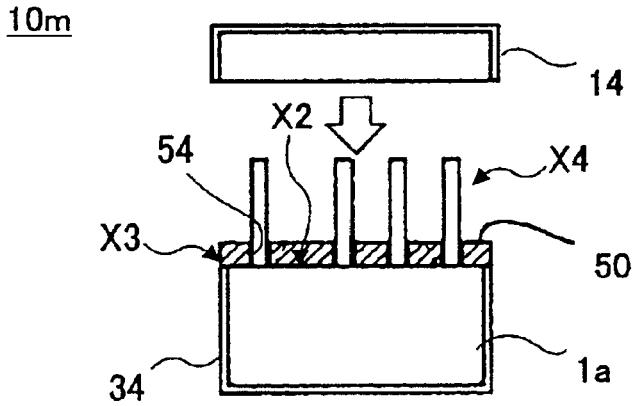
FIG. 41B is an exploded perspective view of the relay shown in FIG. 41A, as seen from another side.
Figure 41C:
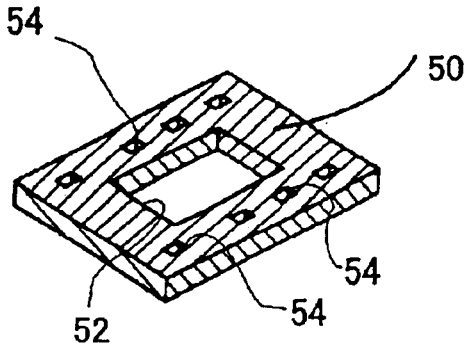
FIG. 41C is a perspective view of the solid adhesive shown in FIG. 41A and FIG. 41B.

The base 14, the cover 34 and the body 1*a* of a relay 10*m* shown in FIG. 41A to FIG. 41C are fixed and unified by being bonded by using a solid adhesive 50 in place of the liquid adhesive 49.

The solid adhesive 50 is formed according to a shape of a bonding part where the body 1*a* and the cover 34 are bonded to the base 14. Specifically, the solid adhesive 50 has an opening 52 so as to avoid a protuberance 53 located on the bottom surface (indicated by arrow X2) of the body 1*a,* the protuberance 53 being not required to be bonded. The solid adhesive 50 also has a plurality of openings 54 around the opening 52. The terminals (indicated by arrow X4) of the body 1*a* are inserted through the respective openings 54. It is noted that the opening 52 will not be formed when the protuberance 53 does not exist on the body 1*a*.

The base 14, the cover 34 and the body 1*a* of the relay 10*m* are fixed and unified all at one time, as follows: in a state where the body 1*a* is contained in the cover 34, the solid adhesive 50 is applied on the bottom surface (indicated by arrow X2) of the body 1*a* and on peripheral parts (indicated by arrow X3) of the cover 34 in the vicinity of the bottom surface of the body 1*a,* and thereafter, the base 14 is put on the cover 34. Then, the relay 10*m* is heated so as to melt the solid adhesive 50. Thereby, the bottom surface of the body 1*a* and the peripheral parts of the cover 34 are bonded to inner surfaces of the bottom of the base 14 so that the base 14, the cover 34 and the body 1*a* are fixed and unified. By using the solid adhesive 50, the base 14, the cover 34 and the body 1*a* can be bonded more simply than by using the liquid adhesive.

Besides, in the heretofore-described embodiments, the insertion holes 18 through which the terminals of the body 1*a* are inserted are formed in the base 14. Here, descriptions will be given, with reference to FIG. 42 to FIG. 45, of various forms of the insertion holes including the forms already mentioned hereinabove.

Figure 42:
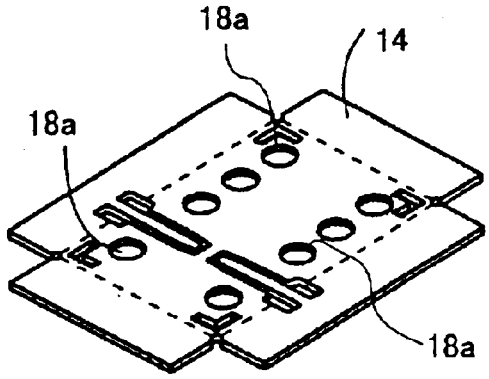
FIG. 42 is a diagram of an example of insertion holes formed in the base through which terminals of the body are inserted.
Figure 43:
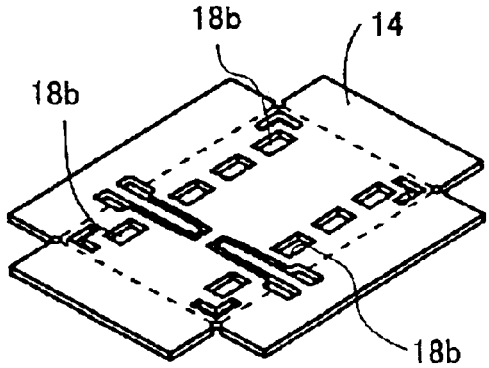
FIG. 43 is a diagram of another example of insertion holes formed in the base.
Figure 44:
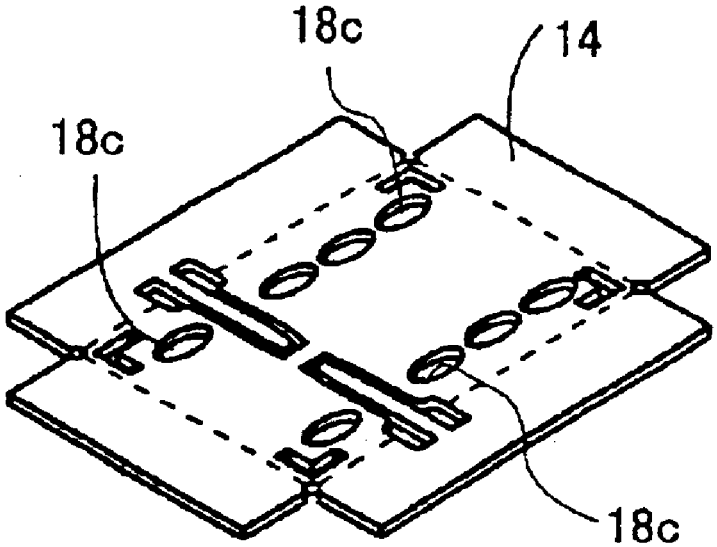
FIG. 44 is a diagram of still another example of insertion holes formed in the base.

Insertion holes 18*a* formed in the base 14 shown in FIG. 42 have circular forms. Insertion holes 18*b* formed in the base 14 shown in FIG. 43 have rectangular forms. Insertion holes 18*c* formed in the base 14 shown in FIG. 44 have elliptic forms. These forms of the insertion holes 18*a* to 18*c* correspond to forms of the terminals inserted thereinto; thus, the insertion holes 18*a* to 18*c* are used in accordance with the forms of the terminals.

Figure 45:
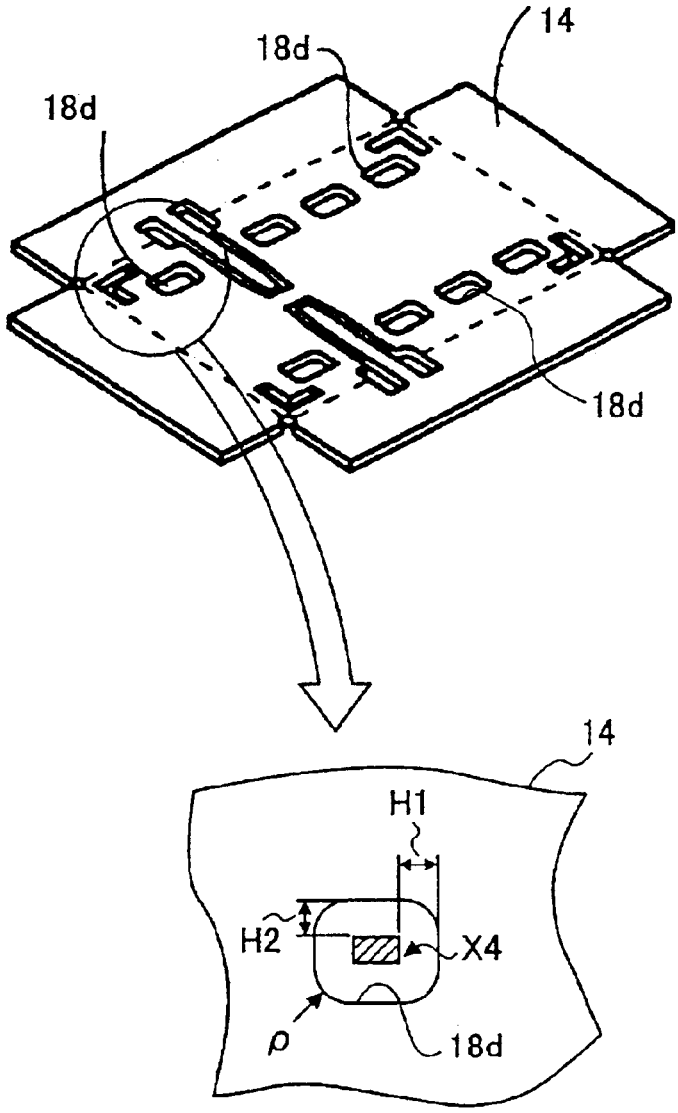
FIG. 45 is a diagram of still another example of insertion holes formed in the base.

Each of insertion holes 18*d* formed in the base 14 shown in FIG. 45 has a substantially rectangular form that has curves replacing angles at four corners. Each of these curves has a curvature radius ρ not larger than gap measurements H1 and H2 between the insertion hole 18*d* and the terminal (indicated by arrow X4) inserted thereinto.

Besides, in the heretofore-described embodiments, the ground terminals or the pad (the ground connection portion) are provided on the base or the cover. Here, descriptions will be given, with reference to FIG. 46A to FIG. 47, of examples of using ground terminals of the body of the relay for grounding the base or the cover.

Figure 46A:
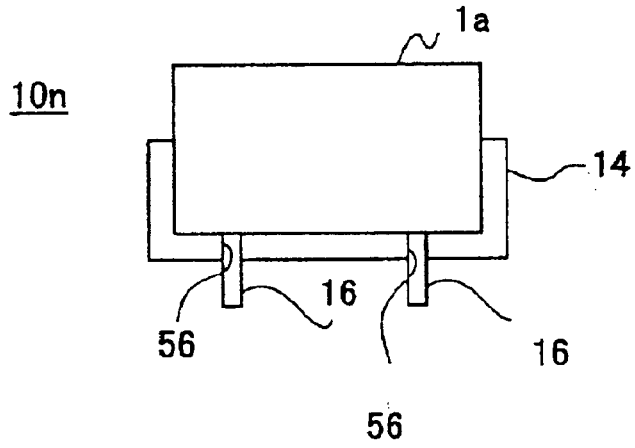
FIG. 46A is a diagram roughly illustrating a structure of the relay, which explains an example of a structure in which ground terminals provided on the body are engaged in engaging holes formed in the base.
Figure 46B:
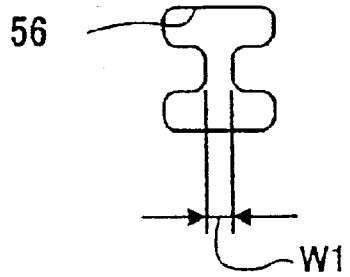
FIG. 46B is a diagram of the engaging holes.
Figure 46C:
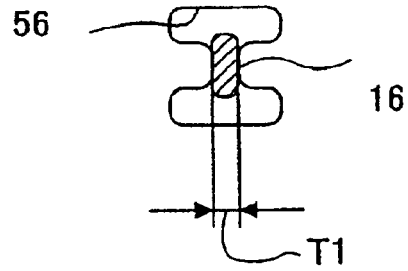
FIG. 46C is a diagram of the ground terminals being engaged in the engaging holes.

In a relay 10*n* shown in FIG. 46A to FIG. 46C, a plurality of the ground terminals 16 are provided on the body 1*a,* and a plurality of engaging holes 56 are formed on the bottom surface 14*a* of the base 14.

Each of the engaging holes 56 is formed in such a H-shape that a width W1 of a part engaging the ground terminal 16 is formed slightly smaller than a thickness T1 of the ground terminal 16.

In the relay 10*n,* when the body 1*a* is inserted into the base 14, the ground terminals 16 of the body 1*a* are pressed into the respective engaging holes 56 of the base 14. Accordingly, the base 14 surely contacts the ground terminals 16; this enables the ground terminals 16 of the body 1*a* to be used for grounding the base 14. In this relay 10*n,* the ground terminals or the pad (the ground connection portion), such as the projection 22 shown in FIG. 15 or the conductive portion 20*a* shown in FIG. 16 need not be provided especially for the base 14.

Figure 47:
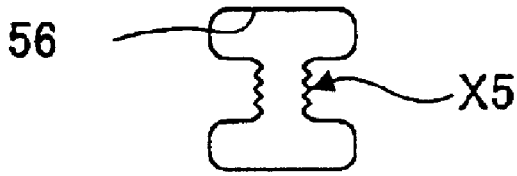
FIG. 47 is a diagram of another example of the engaging holes.

Alternatively, in the relay 10*n,* each of the engaging holes 56 may be so formed that the part (indicated by arrow X5) engaging the ground terminal 16 has a saw-toothed form, as shown in FIG. 47.

Besides, in the heretofore-described embodiments, the standoff portions are provided on the base or the cover. Here, descriptions will be given, with reference to FIG. 48A to FIG. 51B, of various forms of the standoff portions including the forms already mentioned hereinabove.

Figure 48A:
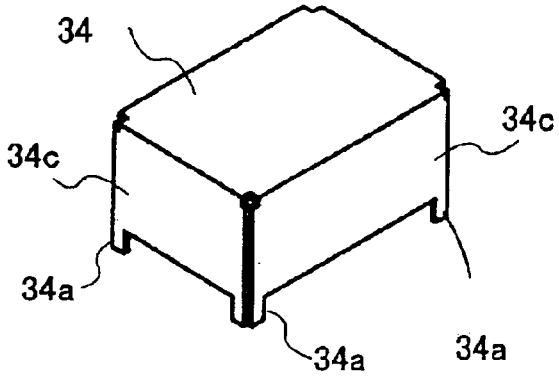
FIG. 48A is a perspective view of an example of the cover provided with standoff portions.
Figure 48B:
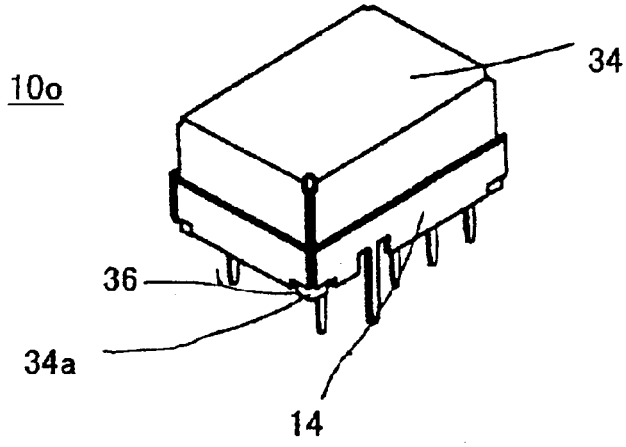
FIG. 48B is a perspective view of the cover shown in FIG. 48A inserted into the base to form a relay.
Figure 48C:
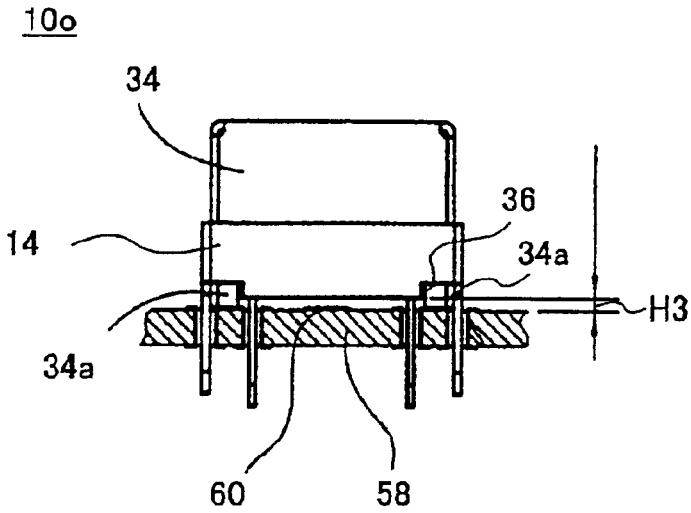
FIG. 48C is a perspective view of the relay shown in FIG. 48B mounted on a substrate.

In a relay 10*o* shown in FIG. 48A to FIG. 48C, the standoff portions 34*a* are provided at the four corners of the lower edges of the sides 34*c* of the cover 34, as shown in FIG. 48A; each of the standoff portions 34*a* has a predetermined height and an L-shaped cross section. The relay 10*o* is assembled by inserting the standoff portions 34*a* into the respective holes 36 of the base 14 containing the body 1*a,* as shown in FIG. 48B.

When the relay 10*o* is mounted on a substrate 58, the standoff portions 34*a* contact the substrate 58 so as to create an insulating gap having a measurement H3 between the base 14 and the substrate 58, as shown in FIG. 48C; thereby, the base 14 and a pattern 60 formed on the substrate 58 can be surely prevented from interfering with each other.

Figure 49A:
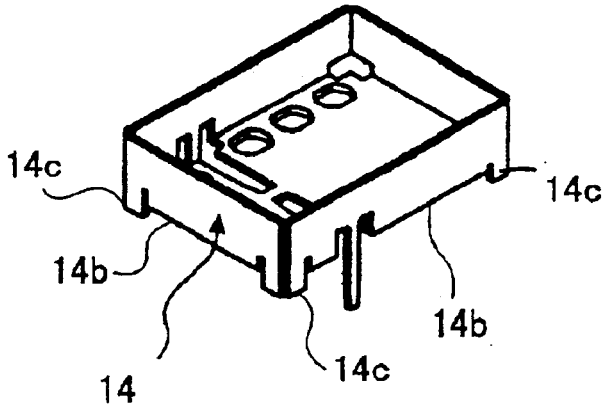
FIG. 49A is a perspective view of an example of the base provided with standoff portions.
Figure 49B:
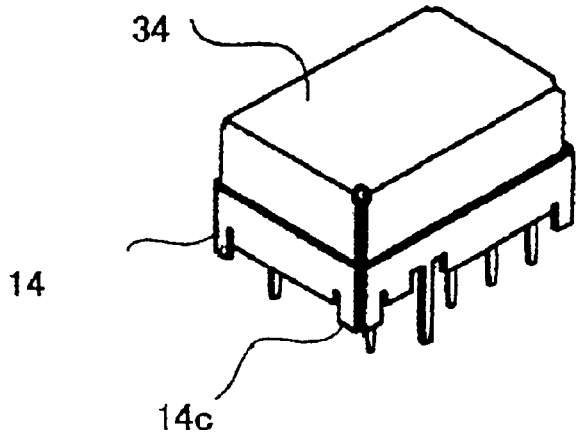
FIG. 49B is a perspective view of the base shown in FIG. 49A covered with the cover to form a relay.

In a relay 10*p* shown in FIG. 49A to FIG. 49B, standoff portions 14*c* are provided at four corners of lower edges of the sides 14*b* of the base 14, as shown in FIG. 49A; each of the standoff portions 14*c* has an L-shaped cross section.

Figure 50A:
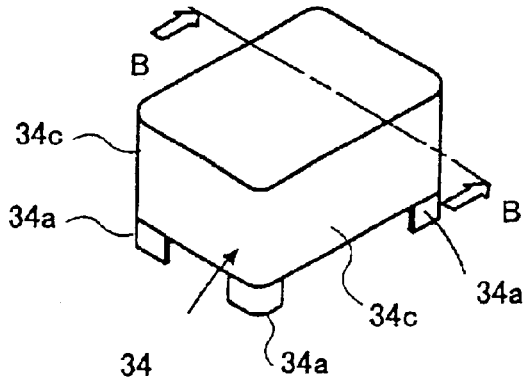
FIG. 50A is a perspective view of another example of the cover provided with standoff portions.
Figure 50B:
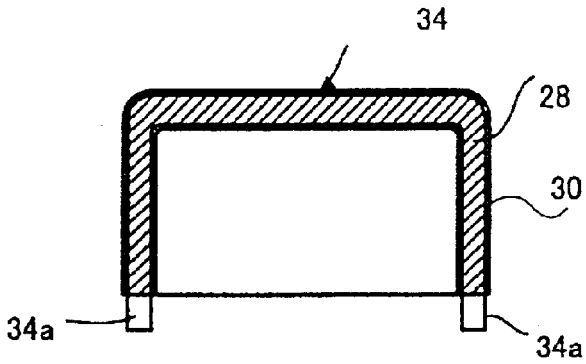
FIG. 50B is a sectional view of the cover shown in FIG. 50A.

The cover 34 shown in FIG. 50A and FIG. 50B is the box member 28 molded from a resin and coated with the metal film 30 on the surface. Further, in FIG. 50A and FIG. 50B, parts of the metal film 30 are etched off from the standoff portions 34*a* at the four corners of the lower edges of the sides 34*c* of the cover 34 so as to expose the box member 28.

Thereby, when the relay is mounted on the substrate, the substrate and the standoff portions 34*a* are surely insulated from each other; i.e., the substrate and the relay are surely insulated from each other.

Figure 51A:
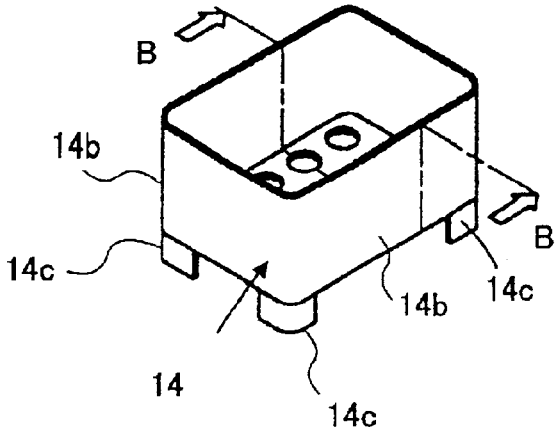
FIG. 51A is a perspective view of another example of the base provided with standoff portions.
Figure 51B:
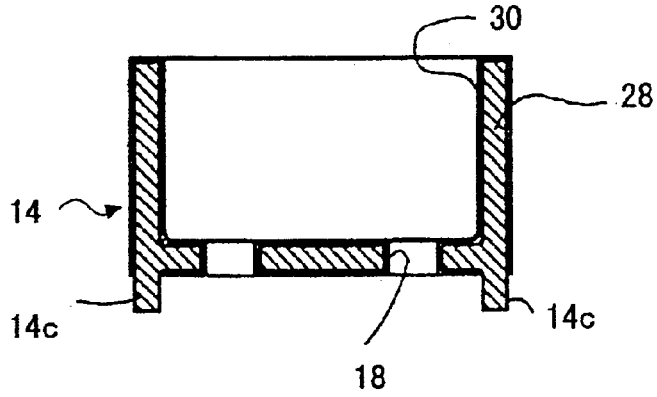
FIG. 51B is a sectional view of the base shown in FIG. 51A.

The base 14 shown in FIG. 51A and FIG. 51B is the box member 28 molded from a resin and coated with the metal film 30 on the surface, as is the cover 34 shown in FIG. 50A and FIG. 50B. Further, in FIG. 51A and FIG. 51B, parts of the metal film 30 are etched off from the standoff portions 14*c* at the four corners of the lower edges of the sides 14*b* of the base 14.

Figure 52:
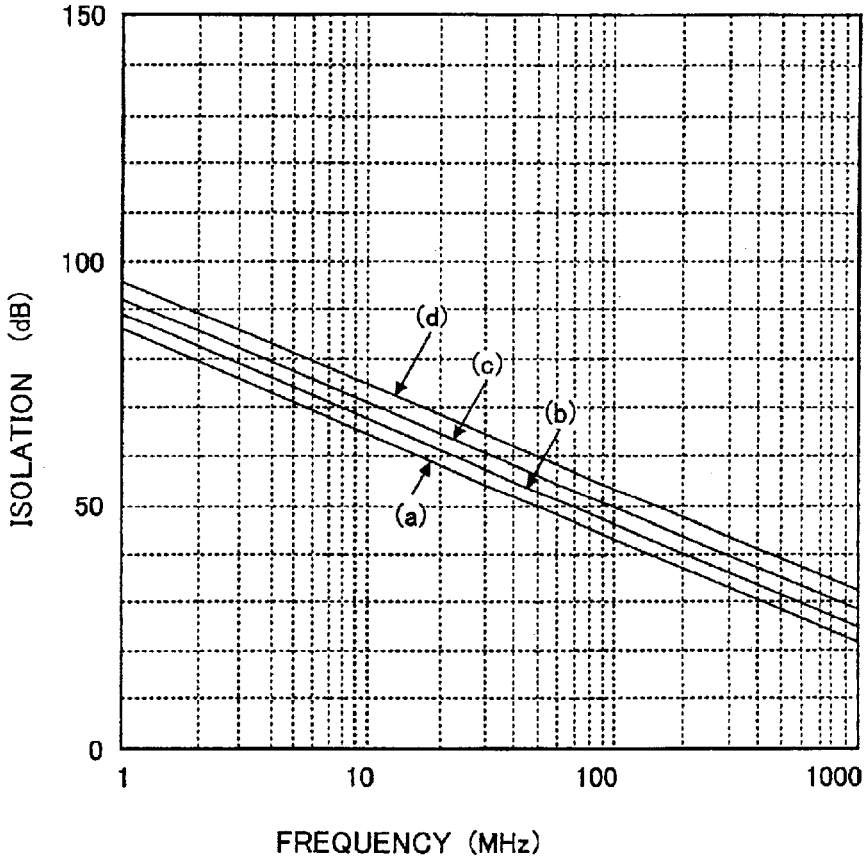
FIG. 52 is a graph representing isolation characteristics of the conventional relays and the relays according to the present invention.

Next, FIG. 52 shows results of measurements of isolation characteristics of the conventional relays and the relays according to the present invention.

The measurements are carried out under condition that transmission impedance of each of the relay is 50 Ω.

Figure 1B:
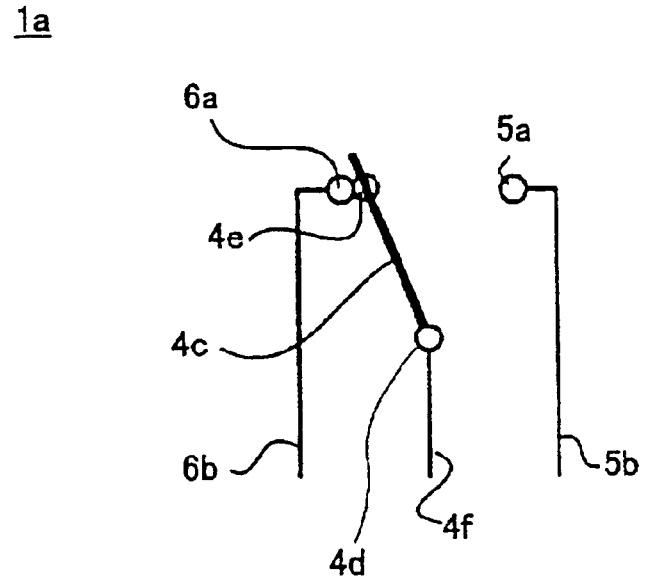
FIG. 1B PRIOR ART
FIG. 1B is a diagram symbolically illustrating the conventional relay shown in FIG. 1A.
Figure 2:
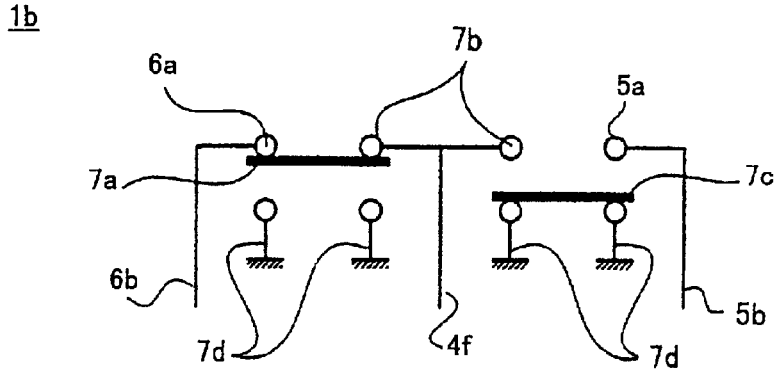
FIG. 2 PRIOR ART
FIG. 2 is a diagram symbolically illustrating another conventional relay different from the relay shown in FIG. 1A and FIG. 1B.
Figure 3:
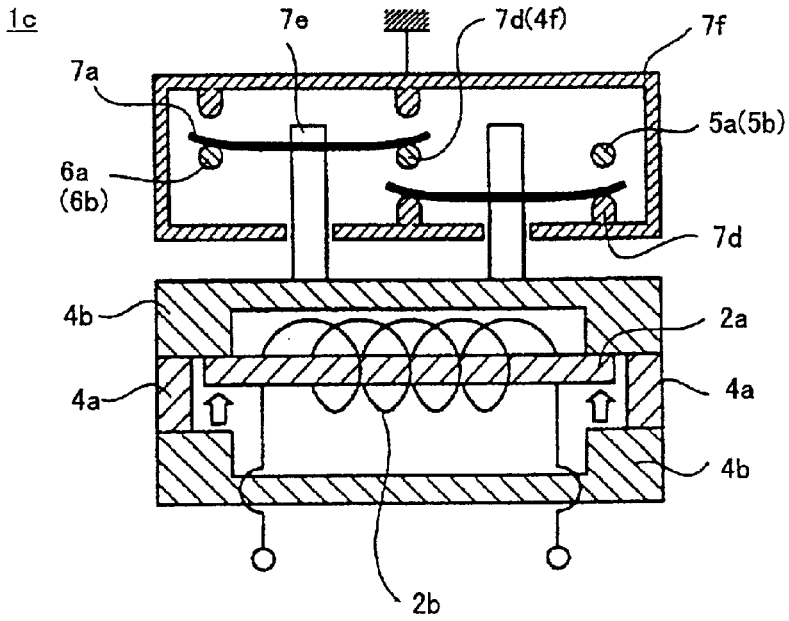
FIG. 3 PRIOR ART
FIG. 3 is a diagram roughly illustrating a structure of still another conventional relay.
Figure 4:
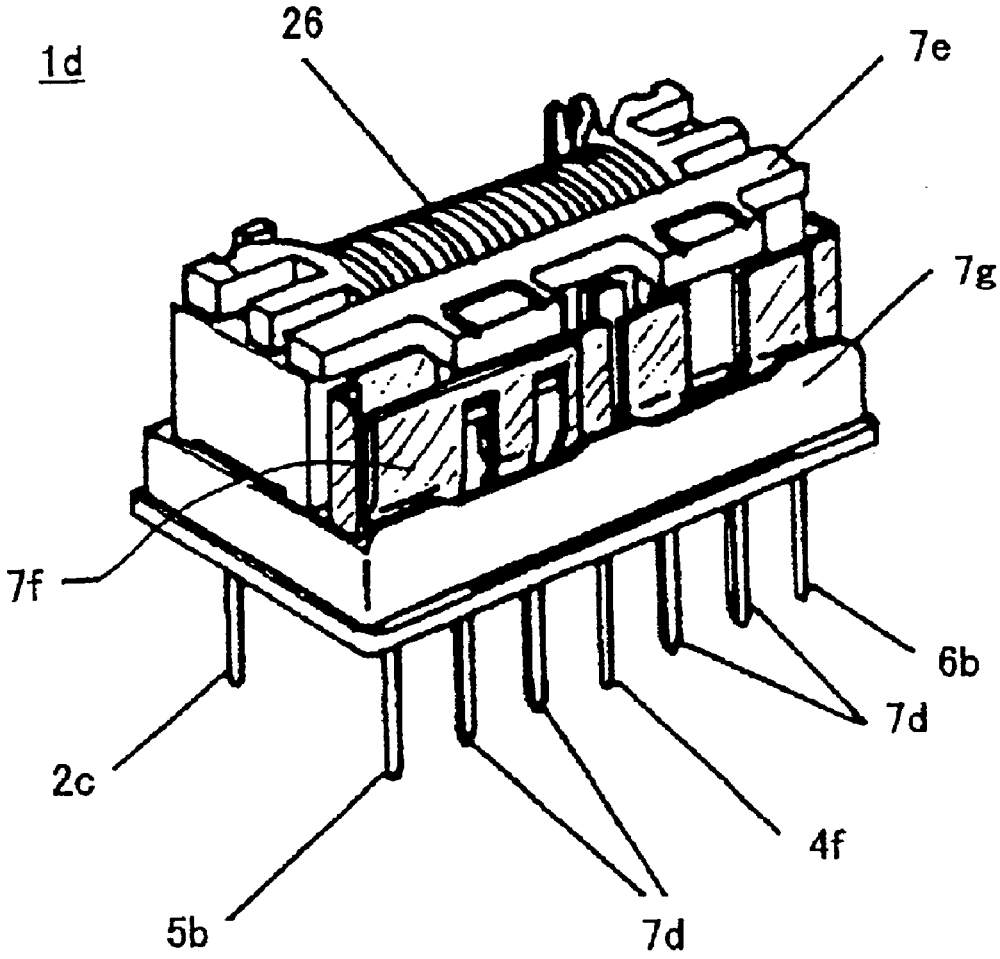
FIG. 4 PRIOR ART
FIG. 4 is a perspective view roughly illustrating a structure of still another conventional relay.
Figure 5A:
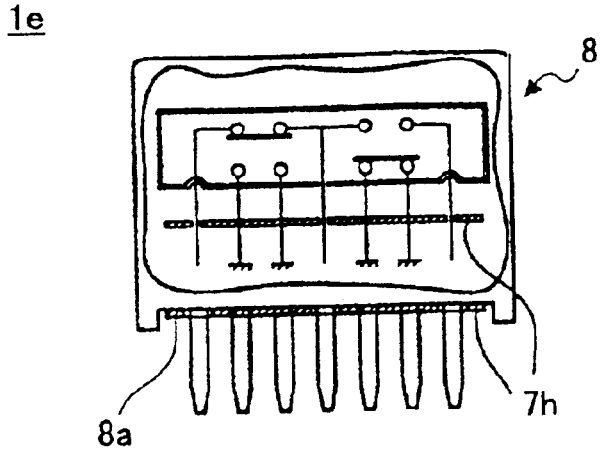
FIG. 5A PRIOR ART
FIG. 5A is a side view illustrating still another conventional relay, transparently in part.
Figure 5B:
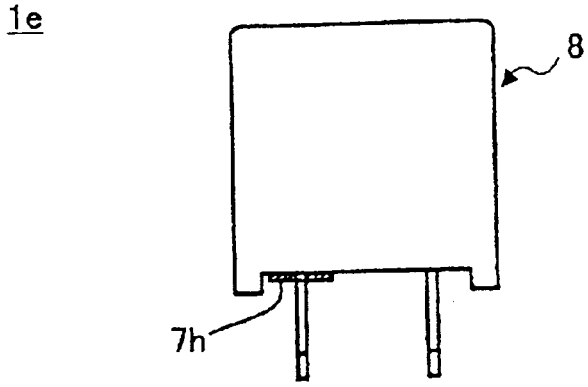
FIG. 5B PRIOR ART
FIG. 5B is another side view of the conventional relay shown in FIG. 5A.
Figure 5C:
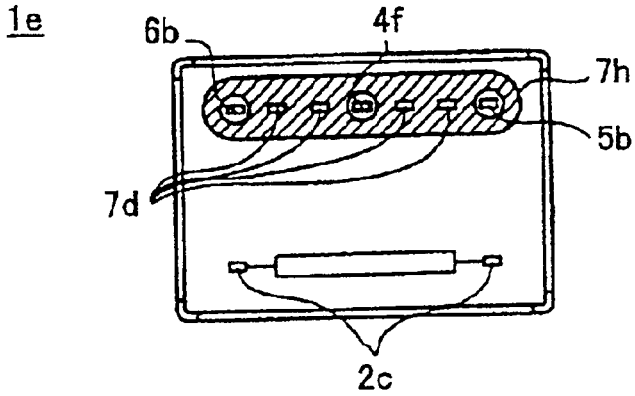
FIG. 5C PRIOR ART
FIG. 5C is a bottom view of the conventional relay shown in FIG. 5A.
Figure 6A:
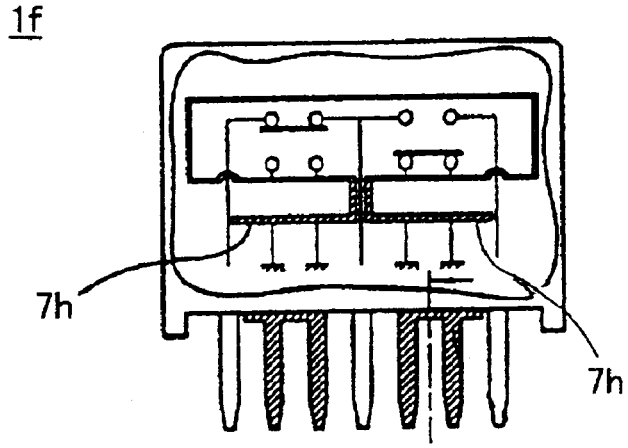
FIG. 6A PRIOR ART
FIG. 6A is a side view illustrating still another conventional relay, transparently in part.
Figure 6B:
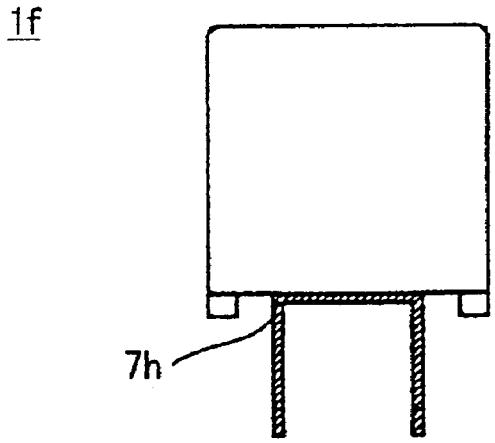
FIG. 6B PRIOR ART
FIG. 6B is another side view of the conventional relay shown in FIG. 6A.
Figure 6C:
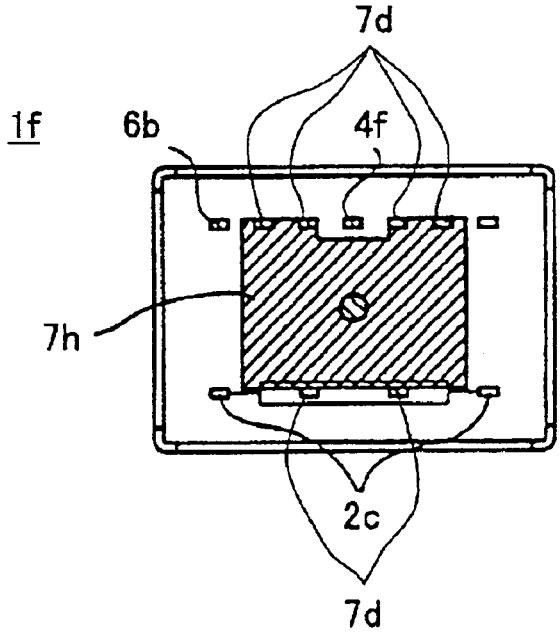
FIG. 6C PRIOR ART
FIG. 6C is a bottom view of the conventional relay shown in FIG. 6A.
Figure 7A:
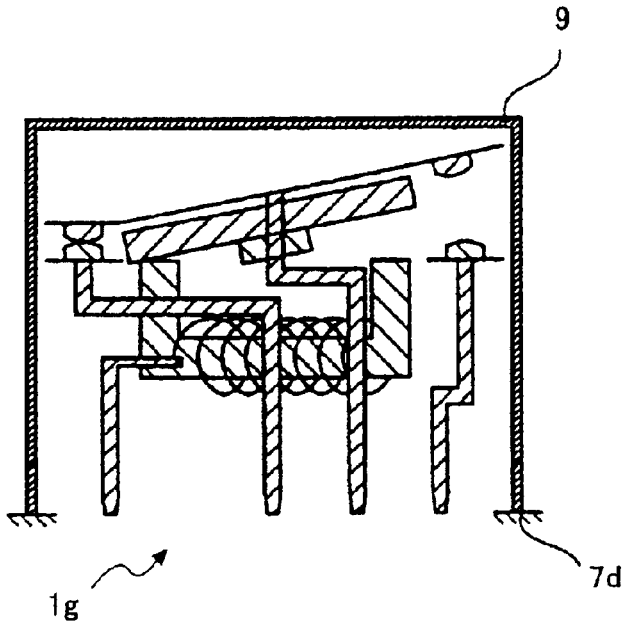
FIG. 7A PRIOR ART
FIG. 7A is a diagram roughly illustrating a structure of still another conventional relay.
Figure 7B:
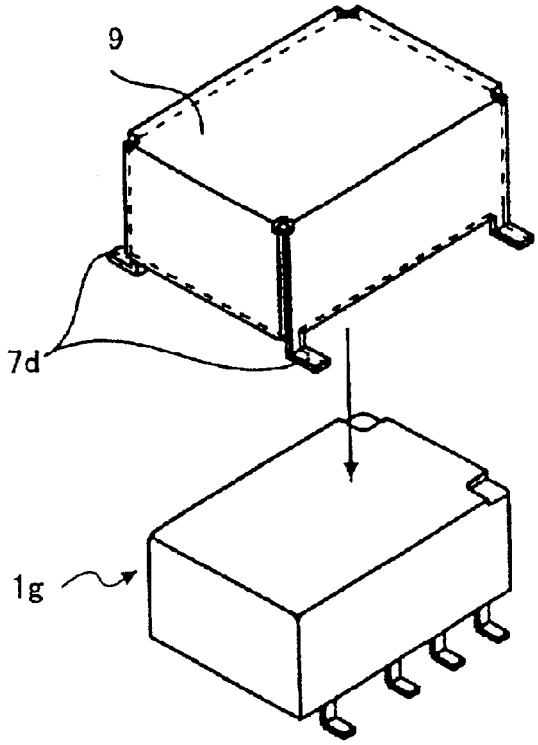
FIG. 7B PRIOR ART
FIG. 7B is an exploded perspective view of the conventional relay shown in FIG. 7A.

In FIG. 52, line (a) represents a measurement result with respect to the conventional relay which is bare without any metal-plate cover and the like as shown in FIG. 1A and FIG. 1B, or the relay covered only with the resinous cover as shown in FIG. 5A to FIG. 5C; line (b) represents a measurement result with respect to the conventional relay covered with the metal case at the top and the sides as shown in FIG. 7A and FIG. 7B; line (c) represents a measurement result with respect to the relay according to the first embodiment of the present invention with the box-shaped base covering the body of the relay as shown in FIG. 8A to FIG. 8C; and line (d) represents a measurement result with respect to the relay according to the fourth embodiment of the present invention with the base and the cover covering the body of the relay completely as shown in FIG. 27A and FIG. 27B. The advantages of the present invention are evident in FIG. 25.

Although the heretofore-described embodiments of the present invention set forth the conventional relay 1*a* as the body of the relay, the body of the relay is not limited thereto as long as the advantages of the present invention are secured. Additionally, the elements described in each of the embodiments are applicable to the corresponding elements in other embodiments as long as the advantages of the present invention are not hindered.

That is, the present invention is not limited to the specifically disclosed embodiments, and variations and modifications may be made without departing from the scope of the present invention.

The present application is based on Japanese priority application No. 2001-328209 filed on Oct. 25, 2001, the entire contents of which are hereby incorporated by reference.

What is claimed is:

1. A high-frequency relay, comprising:

a body containing a contact unit, the contact unit being connected with at least one contact terminal protruding from, and substantially transversely to, a bottom surface of said body, the connection of the contact unit and said at least one contact terminal being switched from an OFF state to an ON state according to energization of a coil; and a conductive base receiving therein the body and covering said bottom surface and side surfaces of said body, the base having a conductive surface providing a grounding function, increasing an electrical isolation characteristic of said high-frequency relay.

2. The high-frequency relay as claimed in claim 1, wherein said base is formed in a box shape having an upward opening and receiving therein and covering said bottom surface and at least portions of four side surfaces of said body.

3. The high-frequency relay as claimed in claim 2, further comprising an openable and closable lid member capable of being closed on said upward opening, the lid member including a conductive layer so as to be electrically connected with said base.

4. The high-frequency relay as claimed in claim 1, further comprising a cover capable of covering surfaces of said body except said bottom surface, the cover including a conductive layer so as to be electrically connected with said base.

5. A high-frequency relay, comprising:

a body containing a contact unit, the contact unit being connected with at least one contact terminal protruded from a bottom surface of said body, the connection of the contact unit and said at least one contact terminal being switched from an OFF state to an ON state according to energization of a coil; and a cover and a base receiving therein the body, the cover covering surfaces of the body except said bottom surface and having a conductive surface providing a grounding function and the base covering said bottom surface and having a conductive surface electrically connected with the conductive surface of said cover and providing a grounding function, the respective grounding functions of said cover and said base increasing an electrical isolation characteristic of said high-frequency relay.

6. The high-frequency relay as claimed in claim 1, wherein said base includes a ground terminal providing a grounding function for the conductive surface.

7. The high-frequency relay as claimed in claim 5, wherein said cover includes a ground terminal providing a grounding function for the conductive surface.

8. The high-frequency relay as claimed in claim 1, wherein said base includes a mounting pad so as to be mounted on a substrate, the mounting pad having said conductive surface providing said grounding function.

9. The high-frequency relay as claimed in claim 1, wherein said base comprises a resinous molding coated with a conductive layer providing the grounding function.

10. The high-frequency relay as claimed in claim 5, wherein said base comprises a resinous molding coated with said conductive layer.

11. The high-frequency relay as claimed in claim 1, wherein said base includes at least one hole through which said contact terminal is inserted.

12. The high-frequency relay as claimed in claim 5, wherein said base includes at least one hole through which said contact terminal is inserted.

13. The high-frequency relay as claimed in claim 4, wherein said base is formed from a metal plate by bending so as to comprise a ground terminal bent from a bottom surface of said base and a defective part formed in said bottom surface of said base by bending said ground terminal;

said cover is formed from a metal plate by bending so as to comprise a foldable projection capable of being folded with respect to said cover; and said defective pert is closed by said foldable projection.

14. The high-frequency relay as claimed in claim 4, wherein said cover comprises a resinous molding coated with said conductive layer.

15. The high-frequency relay as claimed in claim 5, wherein said cover comprises a resinous molding coated with said conductive layer.

16. The high-frequency relay as claimed in claim 4, wherein said cover and said base comprise respective engaging members so that said cover and said base are engaged by said engaging members so as to be unified.

17. The high-frequency relay as claimed in claim 5, wherein said cover and said base further comprises respective engaging members so that said cover and said base are engaged by said engaging members so as to be unified.

18. The high-frequency relay as claimed in claim 4, wherein one of said cover and said base is inserted into the other thereof so as to be unified.

19. The high-frequency relay as claimed in claim 5, wherein one of said cover and said base is inserted into the other thereof so as to be unified.

20. The high-frequency relay as claimed in claim 4, wherein said cover and said base are banded to each other so as to be unified.

21. The high-frequency relay as claimed in claim 5, wherein said cover and said base are bonded to each other so as to be unified.

22. A high-frequency relay comprising:

a body containing a contact unit, the contact unit being connected with a contact terminal and a ground terminal protruding from a bottom surface of said body, the connection of the contact unit and said at least one contact terminal being switched from an OFF stats to an ON state according to energization of a coil; and a base and a cover receiving therein the body, the base covering said bottom surface and including a conductive surface electrically connected with said ground terminal and the cover covering surfaces of amid body except said bottom surface, and including a conductive surface electrically connectable with the conductive surface of said base and providing a grounding function, the respective grounding functions of said cover and said base increasing an electrical isolation characteristic of said high-frequency relay.

23. A high-frequency relay, comprising:

a body containing a contact unit, the contact unit being connected with at least one contact terminal protruding from a bottom surface of said body, the connection of the contact unit and said at least one contact terminal being switched from an OFF state to an ON state according to energization of a coil; and a base and a cover receiving therein the body, the base covering said bottom surface and including a conductive surface providing a grounding function and the cover covering surfaces of said body except said bottom surface and including a conductive surface and providing a grounding function, the respective grounding functions of said cover and said base increasing an electrical isolation characteristic of said high-frequency relay;

a ground terminal formed on one of said base and said cover; and a standoff portion provided on one of said base and said cover.

24. The high-frequency relay as claimed in claim 1, wherein said conductive surface comprises a conductive layer.

25. The high-frequency relay as claimed in claim 2, wherein said base is formed of a conductive material.

26. The high-frequency relay as claimed in claim 25, wherein said conductive material is metal.

27. The high-frequency relay as claimed in claim 5, wherein said conductive surface comprises a conductive layer.

28. The high-frequency relay as claimed in claim 22, wherein said conductive surface comprises a conductive layer.

29. The high-frequency relay as claimed in claim 23, wherein said conductive surface comprises a conductive layer.

30. A high-frequency relay, comprising:

a contact unit having a coil, connected to a coil terminal, and a contact terminal, the contact terminal and the coil terminal protruding from a bottom surface of the contact unit, the coil terminal being connectable to an electrical source for energization of the coil thereby to switch a connection of the contact unit and the contact terminal from an OFF state to an ON state; and a cover and a base receiving therein the body, the cover covering surfaces of said body except said bottom surface and having a conductive surface providing a grounding function and the base covering the bottom surface of the contact unit and having a conductive surface providing a grounding function, the respective grounding functions of said cover and said base increasing an electrical isolation characteristic of said high-frequency relay.

31. The high-frequency relay as recited in claim 30, wherein said base is formed of a box shape having an upward opening and receiving at least part of the contact unit therein and covering said bottom surface thereof and at least portions of four side surfaces of said contact unit.

32. The high-frequency relay as recited in claim 30, comprising:

a cover of a size and configuration to cover surfaces of the contact unit not covered by the base, the cover having a conductive surface surrounding surfaces of the contact unit not covered by the base and electrically connected with the conductive surface of the base.

33. The high-frequency relay as claimed in claim 32, comprising a ground terminal connected to the respective conductive surface of at least one of the cover and the base and performing the grounding function.

* * * * *

UNITED STATES PATENT AND TRADEMARK OFFICE

CERTIFICATE OF CORRECTION

PATENT NO. : 6,960,972 B2
APPLICATION NO. : 10/151969
DATED : November 1, 2005
INVENTOR(S) : Akio Nakamura et al.

It is certified that error appears in the above-identified patent and that said Letters Patent is hereby corrected as shown below:

Title Page, Column 2 (U.S. Patent Documents), Line 5, delete "5,994,988" and insert - - 5,994,986 - - therefor
Title Page, Column 2 (U.S. Patent Documents), Line 5, delete "Ferree et al." and insert - - Takahashi - - therefor.
Column 15, Line 44, delete "pert" and insert - - part - - therefor.
Column 15, Line 66, delete "banded" and insert - - bonded - - therefor.
Column 16, Line 9, delete "stats" and insert - - state - - therefor.
Column 16, Line 14, delete "amid" and insert - - said - - therefor.

Signed and Sealed this

Twenty-ninth Day of August, 2006

JON W. DUDAS
*Director of the United States Patent and Trademark Office*